US011161222B2

(12) United States Patent
Yang et al.

(10) Patent No.: US 11,161,222 B2
(45) **Date of Patent: *Nov. 2, 2021**

(54) WRENCH

(71) Applicants: Weikai Yang, Ruao Town (CN); Jingrong Ye, Hangzhou (CN); Timothy Florian, Tarzana, CA (US)

(72) Inventors: Weikai Yang, Ruao Town (CN); Jingrong Ye, Hangzhou (CN); Timothy Florian, Tarzana, CA (US)

( * ) Notice: Subject to any disclaimer, the term of this patent is extended or adjusted under 35 U.S.C. 154(b) by 92 days.

This patent is subject to a terminal disclaimer.

(21) Appl. No.: 16/803,673

(22) Filed: Feb. 27, 2020

(65) Prior Publication Data

US 2020/0246945 A1 Aug. 6, 2020

Related U.S. Application Data

(63) Continuation-in-part of application No. 16/433,203, filed on Jun. 6, 2019, now Pat. No. 10,668,600.

(60) Provisional application No. 62/802,120, filed on Feb. 6, 2019.

(51) Int. Cl.

| | |
|---|---|
| ***B25B 13/00*** | (2006.01) |
| ***B25B 13/46*** | (2006.01) |
| ***B25B 23/00*** | (2006.01) |

(52) U.S. Cl.

CPC ..... *B25B 13/462* (2013.01); *B25B 23/0007* (2013.01)

(58) Field of Classification Search

CPC ..... B25B 13/462; B25B 23/0007
USPC ..... 81/58.1, 59.1, 60, 61, 63.1
See application file for complete search history.

(56) References Cited

U.S. PATENT DOCUMENTS

| | | | | |
|---|---|---|---|---|
| 835,448 A | | 11/1906 | Lowry et al. | |
| 1,511,226 A | | 10/1924 | Lawrence | |
| 1,609,086 A | | 10/1926 | Hurschman | |
| 2,529,947 A | | 10/1950 | Johnson | |
| 4,457,416 A | * | 7/1984 | Kutzler | F16D 41/088 192/44 |

(Continued)

FOREIGN PATENT DOCUMENTS

CN 209380620 9/2019

OTHER PUBLICATIONS

International Search Report—PCT/US2020/29281—dated Jul. 29, 2020.

(Continued)

*Primary Examiner* — Joseph J Hail
*Assistant Examiner* — Shantese L. McDonald
(74) *Attorney, Agent, or Firm* — Richard J. Bartz; Richard O. Bartz

(57) ABSTRACT

A wrench has a roller motion transmission mechanism that changes reciprocating motion of a driving member to unidirectional rotational motion of a driven member. The wrench has a head with a cylindrical inside wall surrounding a body with a plurality of ramps inclined toward the cylindrical inside wall. A wedging member comprising a cylindrical roller engages each ramp and the cylindrical inside wall of the head. A cage anchored to the body retains the wedging members in contiguous locations relative to the ramps and the cylindrical inside wall of the head. Retainers connected to the cage bias all of the wedging members into engagement with the ramps and the cylindrical inside wall of the head.

31 Claims, 23 Drawing Sheets

(56) References Cited

U.S. PATENT DOCUMENTS

| | | | | |
|---|---|---|---|---|
| 4,884,478 | A | 12/1989 | Lieser | |
| 6,036,130 | A | 3/2000 | Tiejen | |
| 6,050,165 | A | 4/2000 | Hall | |
| 6,253,646 | B1 * | 7/2001 | Chang | B25B 13/462 192/44 |
| 7,066,054 | B2 | 6/2006 | Liu | |
| D528,383 | S | 9/2006 | Albertson | |
| 8,215,207 | B2 | 7/2012 | Huang | |
| 8,516,926 | B1 | 8/2013 | Hsich | |
| 9,140,319 | B2 | 9/2015 | Buchanan | |
| 9,327,389 | B2 | 5/2016 | Chen | |
| 9,415,486 | B2 | 8/2016 | Ludtke et al. | |
| 9,770,813 | B2 | 9/2017 | Wang | |
| 9,902,049 | B2 | 2/2018 | Douglas | |
| 2004/0007097 | A1 | 1/2004 | Matsumoto | |
| 2004/0103760 | A1 | 6/2004 | Phillips | |
| 2005/0076746 | A1 | 4/2005 | Hsien | |
| 2005/0120832 | A1 | 6/2005 | Chiang | |
| 2006/0102442 | A1 | 5/2006 | Dein | |
| 2011/0209584 | A1 | 9/2011 | Suter | |
| 2014/0060257 | A1 * | 3/2014 | Douglass | B25B 13/462 81/59.1 |
| 2016/0129562 | A1 | 5/2016 | Douglass | |
| 2016/0193721 | A1 * | 7/2016 | Douglass | B25B 13/462 81/59.1 |
| 2016/0271761 | A1 | 9/2016 | Chang | |
| 2018/0079055 | A1 | 2/2018 | Wang | |
| 2018/0099055 | A1 | 4/2018 | Wang | |
| 2020/0230787 | A1 | 7/2020 | Zhao | |
| 2021/0101261 | A1 | 4/2021 | Ye et al. | |

OTHER PUBLICATIONS

Written Opinion of International Searching Authority—PCT/US2020/29281—dated Jul. 29, 2020.

* cited by examiner

WRENCH

CROSS REFERENCE TO RELATED APPLICATION

This application is a continuation-in-part of U.S. Application Ser. No. 16/433,203 filed Jun. 6, 2019, now U.S. Pat. No. 10,668,600. Application Ser. No. 16/433,203 claims the benefit of U.S. Patent Application Ser. No. 62/802,120 filed Feb. 6, 2019.

FIELD OF THE INVENTION

The invention relates to hand tools for turning fasteners. The hand tools are wrenches with motion transmitting mechanisms operable to rotate fasteners in response to angular movements in one direction and prevent rotation of the fasteners in response to movements in a reverse direction.

BACKGROUND OF THE INVENTION

Ratchet wrenches having motion transmission mechanisms are used in automotive, industrial, farm shop and home applications to install and remove threaded fasteners. The motion transmission mechanisms used in ratchet wrenches have structures that are operable to transmit torque applied to the handles of the wrenches to driven bodies or spindles coupled to threaded fasteners and alternatively prevent the transfer of torque to the driven bodies or spindles. Ratchet wrench motion transmission mechanisms with a driving gear and a spring loaded pawl are used to rotate a fastener in one direction and prevent rotation of the fastener in a reverse direction without removing the wrench from the fastener. A large amount of angular movement of the handle of these ratchet wrenches are required to rotate a fastener. The required angular movement of the handle of the ratchet wrench eliminates the use of the ratchet wrench in confined environments. Ratchet wrenches having motion transmission mechanisms that operate with a minimum of back lash or lost motion during the reverse movement have cylindrical rollers that engage ramps on driven bodies and cylindrical walls of drive members. Springs and elastic members are interposed between the rollers and driven bodies to hold the rollers in wedging position between the ramps and cylindrical walls of the drive members, such as the heads of wrenches.

Ratchet wrenches having cylindrical rollers biased with springs into engagement with inclined ramps on driven bodies and cylindrical walls of the heads of the wrenches are shown and described in the following U.S. patents and U.S. published patent application.

C. B. Lowry and R. Bernhard in U.S. Pat. No. 835,448 disclose a wrench with a handle joined to a head having an internal cylindrical wall. A body with a plurality of steel inserts providing ramps for rollers retained in carriages. Each carriage retains two rollers in engagement with two ramps and adjacent cylindrical wall of the head. Coil springs engage the body and carriages to bias the carriages to hold the rollers in wedging engagement with the ramps and adjacent cylindrical wall of head whereby clockwise movement of the handle and head rotates the body and counterclockwise movement of the handle and head does not rotate the body. The carriage is not anchored to the body.

S. O. Lawrence in U.S. Pat. No. 1,511,226 discloses a wrench having a handle joined to a head. The head has a cylindrical inside surface surrounding an opening for accommodating a body. The outer portion of the body has a series of pockets accommodating cylindrical rollers that wedge between the body and head for rotation in one direction and to release the rollers to prevent the body from rotation in a reverse direction. In order to avoid lost motion of the rollers, flat springs engage the rollers to hold the rollers in wedging positions in the pockets.

R. A. Johnson in U.S. Pat. No. 2,529,947 discloses a roller clutch wrench having a head at the outer end of a handle. The head has an internal cylindrical surface surrounding an opening. A clutch body located in the opening has spaced notches with ramps. Ridges located between the ramps contact the cylindrical surface of the head. A roller located in each pocket is biased with a spring into wedging contact with the ramp and cylindrical surface of the head whereby clockwise movement of the handle and head rotates the clutch body and counterclockwise movement of the handle and head does not rotate the clutch body.

C. T. Chang in U.S. Pat. No. 6,253,646 discloses a wrench having a handle joined to a head. The head has an inside circumferential wall having a plurality of arcuate recesses. A body with a cylindrical outer wall is located in an opening surrounded by wall with the recesses. Rollers located in the recesses engage the outer wall of the body to transmit torque from the head to the body during angular movement of the head and handle. A ring located on the body has C-shaped portions accommodating the rollers. A control device mounted on the head is used to rotate the ring to concurrently shift the ring to selectively move the rollers to clockwise and counterclockwise positions. A modification of the wrench has a head with a continuous inside cylindrical wall. The body has a plurality of ramps providing pockets for rollers. The ring biases the rollers into engagement with the inside cylindrical wall of the body whereby on angular movement of the handle in a clockwise direction the roller wedges between the ramps and inside cylindrical wall to rotate the body and on movement of the handle in a counterclockwise direction the rollers move to non-wedging locations in the pockets. The wrench is an improvement of a ratchet wrench having anti-reverse rollers and elastic members that bias the rollers into contact with ramps and a cylindrical wall of the head of the wrench.

M. Wang in U.S. Patent Application Publication No. 2018/0079055 discloses wrenches having unidirectional motion transmission mechanisms for rotating a nut or bolt head. Each wrench has a handle joined to a head having an internal cylindrical wall surrounding an opening. A body having inclined ramps is interposed in the opening and retained in the head. A cylindrical roller engages each ramp and adjacent cylindrical wall of the head. A spring between the body and roller biases the roller into contact with the ramp and adjacent cylindrical wall of the head. Movement of the handle and head in a clockwise direction wedges the roller into torque transmitting relationship with the ramp and cylindrical wall of the head thereby rotating the body. Movement of the handle and head in the opposite direction releases the torque transmitting relationship of the roller with respect to the ramp and cylindrical wall of the head whereby the body does not reverse rotate when the handle and head are moved in the reverse direction. One embodiment of the wrench has a holder having slots for accommodating the rollers. Elastic members or springs bias the rollers into contact with ramps and cylindrical wall of the head.

SUMMARY OF THE INVENTION

The invention relates to a hand tool used to rotate threaded fasteners, such as nuts and bolts. The hand tool is a roller type ratchet wrench having a handle joined to a head having a cylindrical inside wall surrounding a rotatable spindle or body. The body has a bore accommodating a fastener to rotate the fastener with the body. The body also has ramps inclined outwardly relative to the cylindrical inside wall of the head. Wedging members are located between the ramps and cylindrical inside wall. An annular cage anchored to the body locates the wedging members in engaging positions with respect to the ramps and the cylindrical inside wall of the head. Retainers on the cage engage the wedging members to hold all the wedging members in their engaging positions with respect to the ramps and inside cylindrical wall of the head. Movement of the handle and head in one arcuate direction moves all the wedging members from their engaging positions into driving or wedging locations with the ramps and cylindrical wall of the head whereby the body and fastener held by the body are rotated. Movement of the handle and head in an arcuate direction reverse or opposite the one arcuate direction releases the wedging members from their wedging relation with the ramps and cylindrical wall of the head.

The hand tool is a roller wrench for turning fasteners, such as nuts, bolts and screws in selected opposite directions. The wrench has an elongated handle having an end joined to a head. The head has a cylindrical inside wall perpendicular to the longitudinal length of the handle. The cylindrical inside wall of the head surrounds an opening accommodating a spindle or body. The cylindrical inside wall has a central axis perpendicular to the longitudinal length of the handle. The head is the driving member and the body is the driven member of the wrench. The body has an inside wall with ribs adapted to engage a fastener whereby upon rotation of the body the fastener is rotated. The body has a plurality of linear ramps that are inclined outwardly toward the cylindrical inside wall of the head. The ramps are spaced around the outer wall of the body. The outer ends of the ramps have ridges or corners. A cylindrical roller is located between each ramp and the inside cylindrical wall of the head. A cage located around the body has inside walls providing recesses for the ridges of the ramps to anchor and lock the cage to the body. The cage does not rotate relative to the body. The cage has a cylindrical side wall having slots or openings and wall segments having surfaces located in contiguous relation to the inside cylindrical wall of the head. A cylindrical roller located in each slot is retained by the cage in an engaging position with a ramp and the inside cylindrical wall of the head. A retainer located in each slot contacts the cage and cylindrical roller to move and maintain the cylindrical roller in its engaging position with a ramp and cylindrical inside wall of the head. The retainer has a boss or member joined to the cage and a pair of elastic arms projected in opposite directions from the boss. The arms have outer ends that contact opposite end portions of the cylindrical roller to bias and hold the cylindrical roller in the engaging position with the ramp and cylindrical inside wall of the head. Movement of the handle in a first arcuate direction rotates the head and moves all of the cylindrical rollers from their engaging positions between the ramps and inside cylindrical wall of the head to wedging or locking positions between the ramps and the cylindrical inside wall of the head. When the rollers are in the wedging positions the arcuate movement of the handle is converted to unilateral rotation of the body. Movement of the handle in a second arcuate direction opposite the first arcuate direction moves the cylindrical rollers from the wedging positions to the engaging positions with the ramps and cylindrical inside wall of the head whereby the cylindrical rollers are released from their wedging positions and return to the engaging positions relative to the ramps and the cylindrical inside wall of the head. Movement of the cylindrical rollers between their engaging positions and wedging positions has a minimum of lost motion enabling the wrench to be used in confined and space restrictive environments.

The wrench includes a method of converting reciprocating motion to unidirectional rotational motion of a fastener. The wrench has a head with a cylindrical inside wall, a body having inclined ramps facing the cylindrical inside wall of the head and a cage surrounding the body holding cylindrical rollers between the cylindrical inside wall of the head and the ramps. The method is achieved by anchoring the cage on the body to prevent rotational movement of the cage relative to the body and locating each of the cylindrical rollers with the anchored cage between a ramp and the cylindrical inside wall of the head. The ramp and cylindrical inside wall of the head engaging positions of the cylindrical rollers are maintained by using retainers joined to the cage to bias the cylindrical rollers in engagement with the ramps and the cylindrical inside wall of the head. The head is moved in a first arcuate direction whereby the cylindrical inside wall of the head moves each cylindrical roller from the ramp and the cylindrical inside wall engaging position to a ramp and cylindrical inside wall wedging position thereby rotating the body and fastener connected to the body in a first direction and subsequently moving the head in a second arcuate direction opposite the first arcuate direction to release the ramps and cylindrical inside wall wedging position of each cylindrical roller without rotating the body and fastener.

DESCRIPTION OF THE INVENTION

Figure 1:
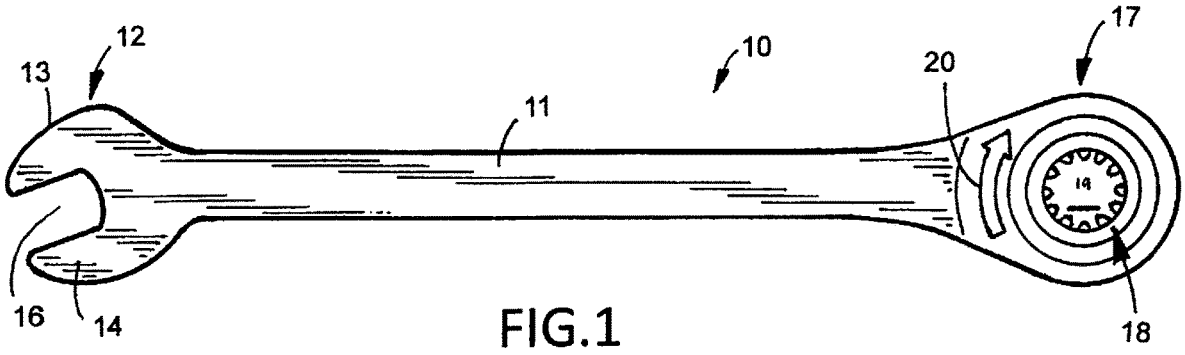
FIG. 1 is a front elevational view of a first embodiment of the combination box and roller wrench of the invention.
Figure 2:
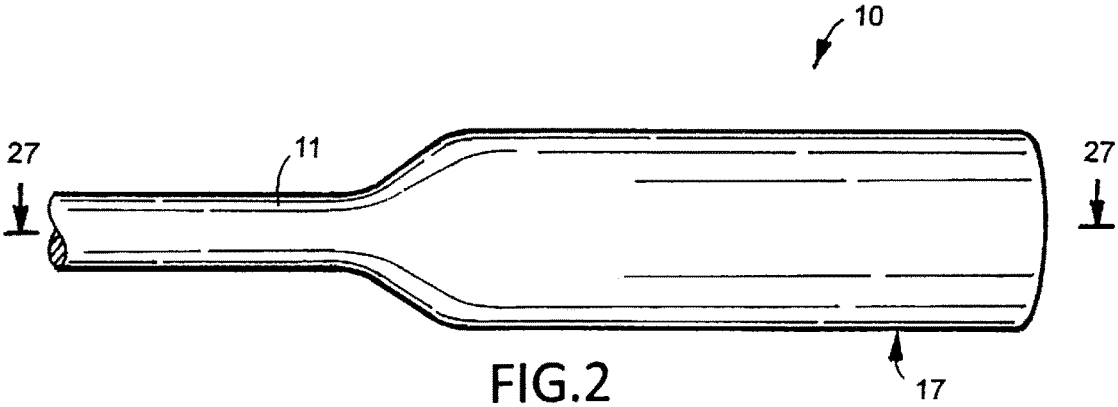
FIG. 2 is an enlarged side elevational view of the head end of the wrench of FIG. 1.
Figure 3:
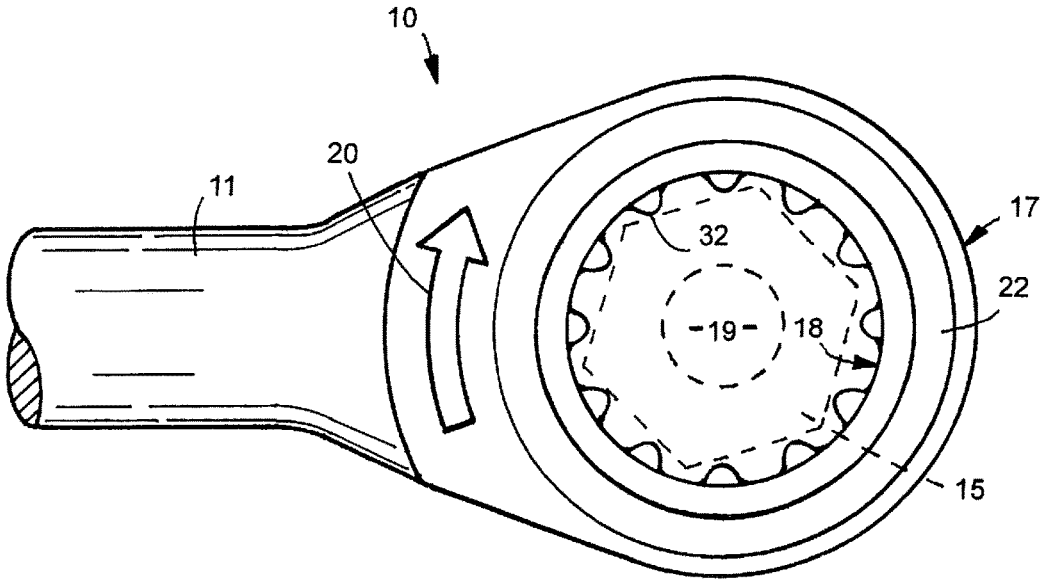
FIG. 3 is a top plan view of FIG. 2.

A hand tool, shown in FIGS. 1 to 5, is a combination box and roller wrench 10 comprising a linear handle 11, a box end 12 and a roller end or head 17. Box end 12 has laterally separated jaws 13 and 14 providing a nut or a bolt head opening 16 for accommodating a conventional nut or a head of a bolt or screw. Box end 12 and head 17 joined to opposite sections of handle 11 are a one-piece metal structure. Head 17 surrounds a fastener 15, such as a nut or head of a bolt or screw. As shown in FIG. 3, when handle 11 is moved in a clockwise direction, indicated by arrow 20, a right hand fastener 15 is turned onto its threaded member (not shown). Moving handle 11 in the opposite or counterclockwise direction, indicated by arrow 21, turns fastener 15 off of its threaded member.

Figure 4:
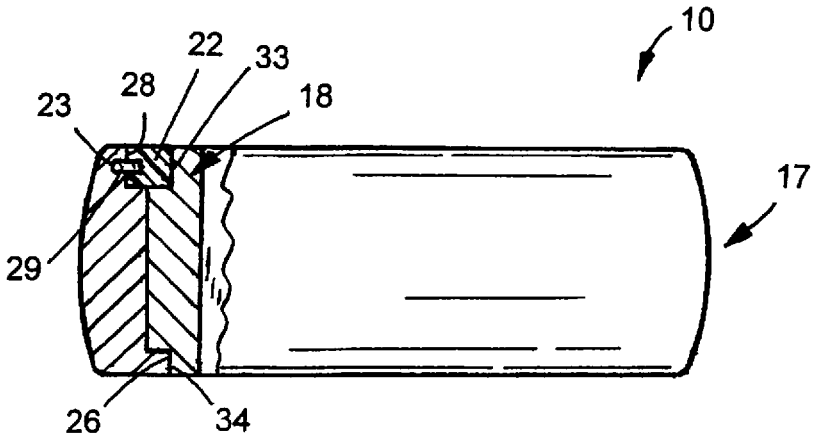
FIG. 4 is a partly sectioned end elevational view of FIG. 2.
Figure 5:
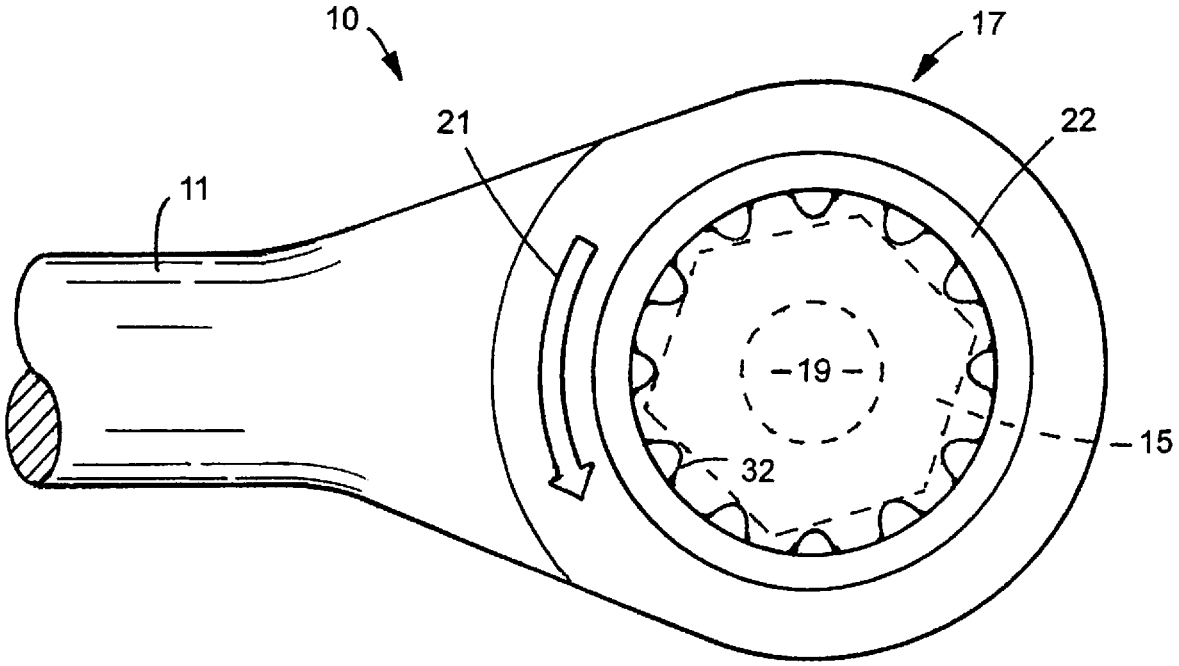
FIG. 5 is a bottom plan view of FIG. 2.
Figure 6:
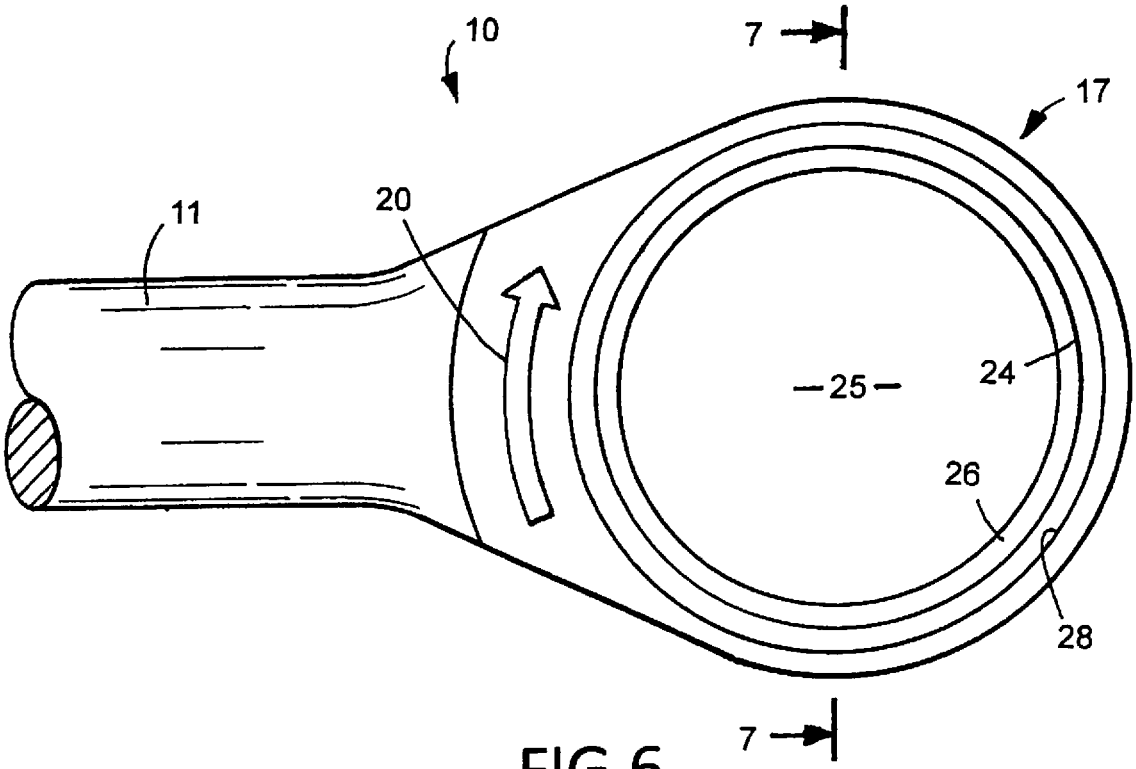
FIG. 6 is an enlarged top plan view of the head of the wrench of FIG. 1.
Figure 7:
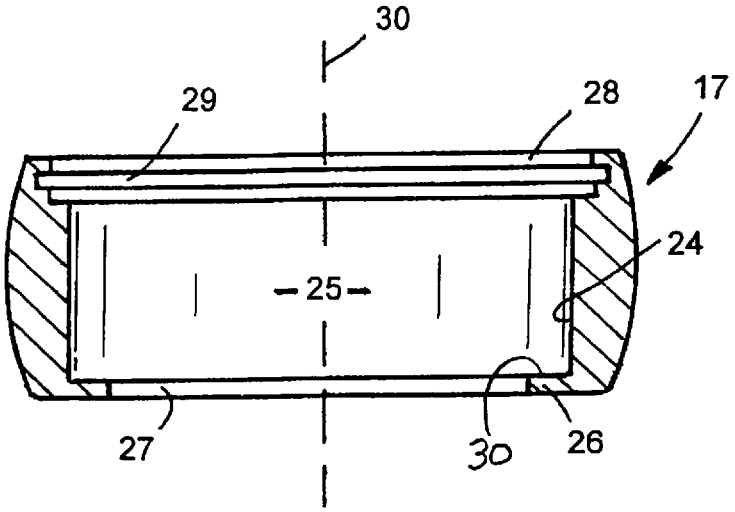
FIG. 7 is a sectional view taken along line 7-7 of FIG. 6.

Proceeding to FIGS. 6 and 7, head 17 is a generally cylindrical member having a cylindrical inside wall 24 surrounding an opening 25 accommodating a driven member or body 18. Wall 24 has a continuous cylindrical inside surface concentric with the axis 30 of head 17. Axis 30 is perpendicular to the longitudinal length of handle 11. Head 17 has an annular bottom wall 26 at the bottom of wall 24. Wall 26 is an inwardly extended lip or annular flange surrounding an opening 27 adjacent the bottom of opening 25. Head 17 has a bottom annular surface 30 located on wall 26. The flange can be connected to head 17 with a C-shaped spring, such as a member 28 shown in FIG. 4. Head 17 also has a top inside wall 28 having an annular groove or recess 29. As shown in FIG. 4, a cylindrical ring 22 fits into the space surrounded by inside wall 28 of head 17. A member 23, such as a C-shaped spring, extended in recess 29 retains ring 22 on head 17. Ring 22 engages body 18 to hold body 18 in a rotational relationship with head 17.

Figure 8:
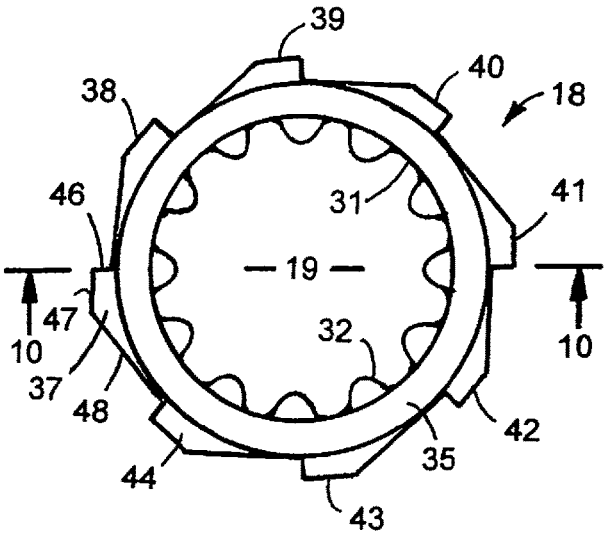
FIG. 8 is a top plan view of the driven body of the wrench shown in FIGS. 1 to 5.
Figure 9:
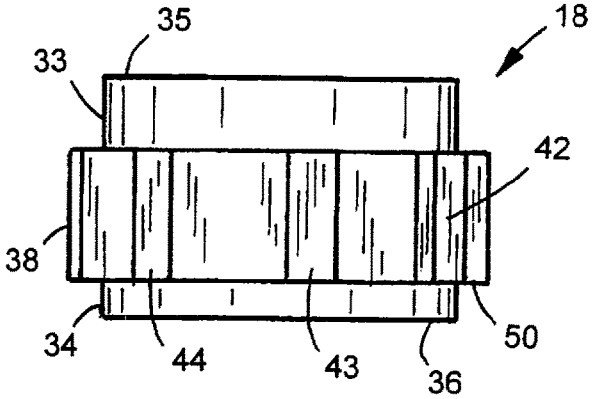
FIG. 9 is a bottom side elevational view of FIG. 8.
Figure 10:
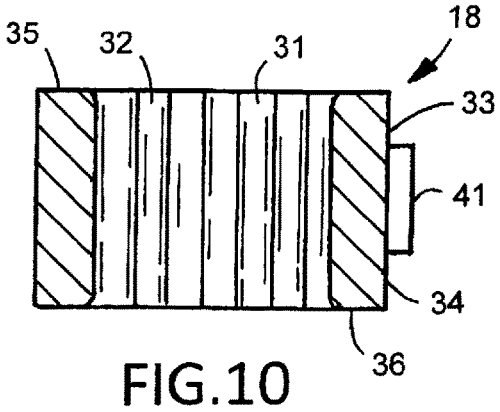
FIG. 10 is a sectional view taken along line 10-10 of FIG. 8.

As shown in FIGS. 8 to 10, body 18 has first cylindrical surface 33 and a second cylindrical surface 34. First cylindrical surface 33 terminates at the top annular wall 35 of body 18. Second cylindrical surface 34 is an external surface that terminates at the bottom annular wall 36 of body 18. The circumferential surfaces 33 and 34 having the same diameter. Alternatively, circumferential surfaces 33 and 34 can have different diameters. Returning to FIG. 4, ring 22 engages circumferential surface 33 whereby body 18 is rotatably located in the opening 25 of head 17.

Figure 11:
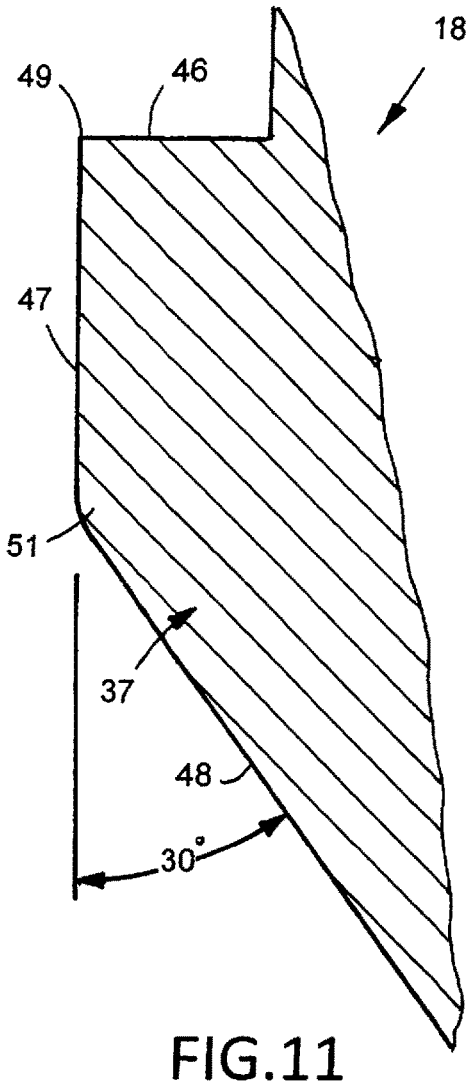
FIG. 11 is an enlarged profile view of one of the protrusions shown in FIG. 8.

Body 18, shown in FIG. 8, has a cylindrical inside wall 31 having a series of inwardly extended ribs 32. Adjacent ribs 32 are circumferentially spaced from each other providing grooves to accommodate corner portions of the hexagonal or square fastener 15 to driveably couple body 18 with fastener 15. The illustrated embodiment, shown in FIG. 8, has twelve ribs. The number, configuration and size of the ribs can vary. The inside wall 31 of body 18 can have a hexagonal shape without ribs to accommodate a hexagonal fastener. Body 18 includes a series of teeth or protrusions 37, 38, 39, 40, 41, 42, 43 and 44 located radially around the outer circumference of body 18 between cylindrical surfaces 33 and 34. The illustrated embodiment, shown in FIGS. 3, 5, 8 and 28, depicts eight protrusions evenly spaced around body 18. The number of protrusions can be more or fewer than shown in FIGS. 3, 5, 8 and 27. The profile of protrusions 37 is illustrated in FIG. 11. Protrusion 37 has a radial flat shoulder 46 extended outwardly to an arcuate ridge 47. An outwardly inclined ramp 48 also extends to ridge 47. Ramp 48 is inclined outwardly at an angle of 30 degrees relative to the outer surface of ridge 47. The angular relationship between ridge 47 and ramp 48 can vary. The surface of ramp 48 is linear and flat. The surface of ramp 48 can include a concave curved portion and a flat portion. The flat portion is located adjacent shoulder 46 and the concave curved portion extending from the flat portion of ridge 47. Ridge 47 terminates in opposite corner portions or edges 49 and 51. Protrusions 38, 39, 40, 41, 42, 43 and 44 have the same profile as protrusions 37 shown in FIG. 11.

Figure 12:
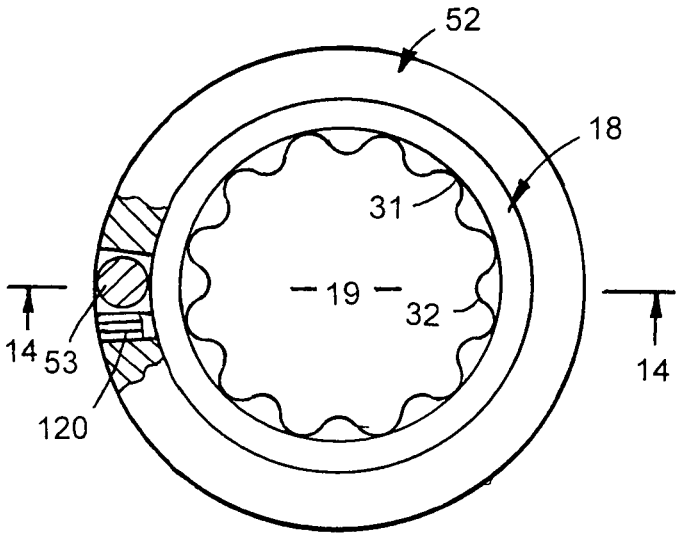
FIG. 12 is a top plan view, partly sectioned, of the combined driven body and roller cage of the wrench of FIG. 1.
Figure 13:
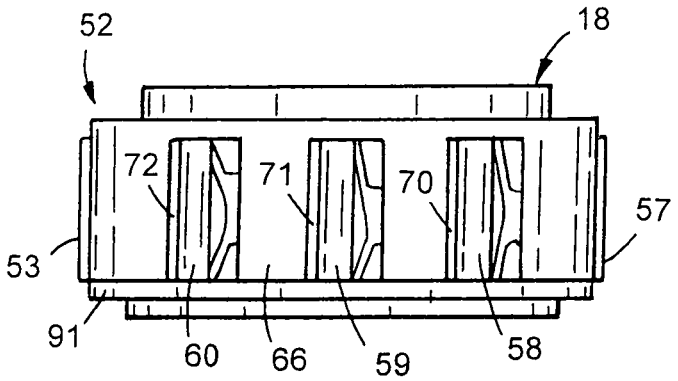
FIG. 13 is a bottom side elevational view of FIG. 12.
Figure 15:
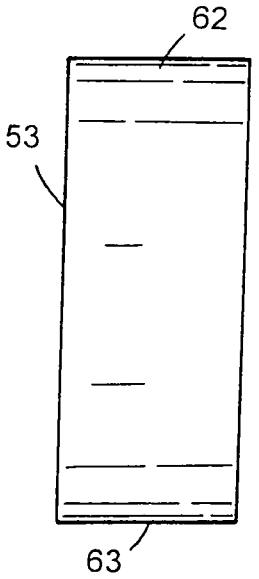
FIG. 15 is an enlarged front elevational view of a cylindrical roller separated from the roller cage.
Figure 14:
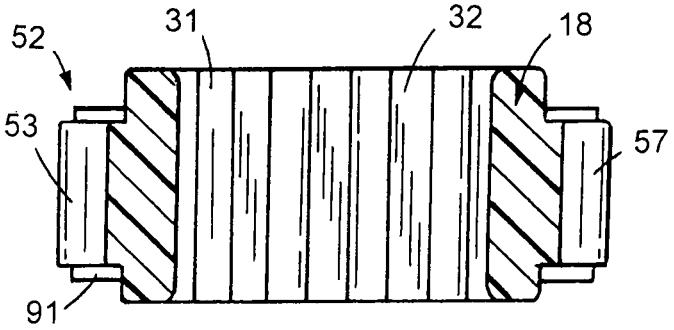
FIG. 14 is a sectional view taken along line 14-14 of FIG. 12.
Figure 16:
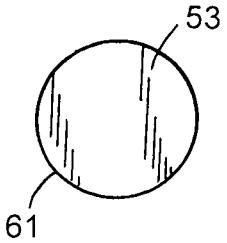
FIG. 16 is an end view of FIG. 15.
Figure 17:
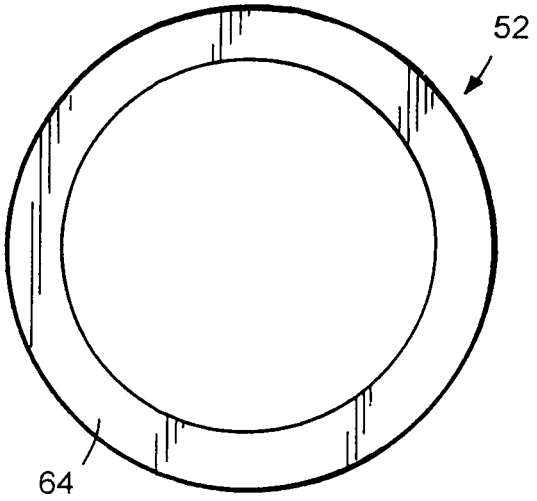
FIG. 17 is a top plan view of the first member of the roller cage.
Figure 20:
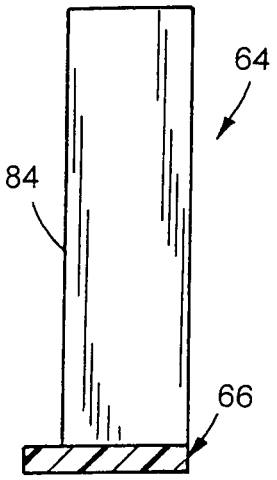
FIG. 20 is an enlarged sectional view taken along line 20-20 of FIG. 19.
Figure 18:
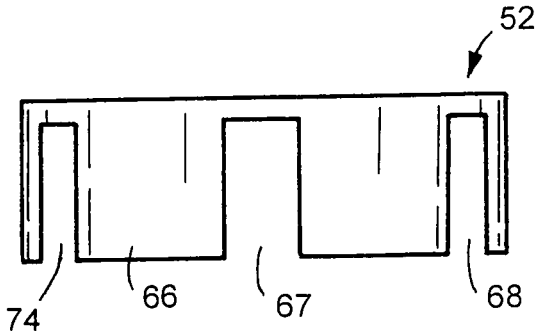
FIG. 18 is a bottom side elevational view of FIG. 17.
Figure 21:
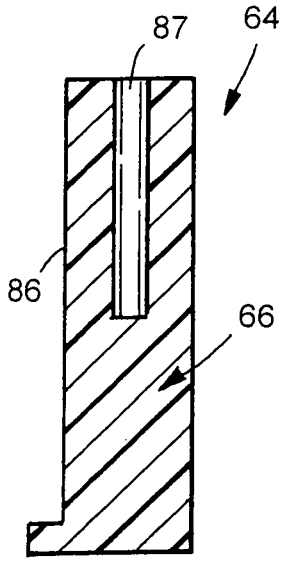
FIG. 21 is an enlarged sectional view taken along line 21-21 of FIG. 19.
Figure 27:
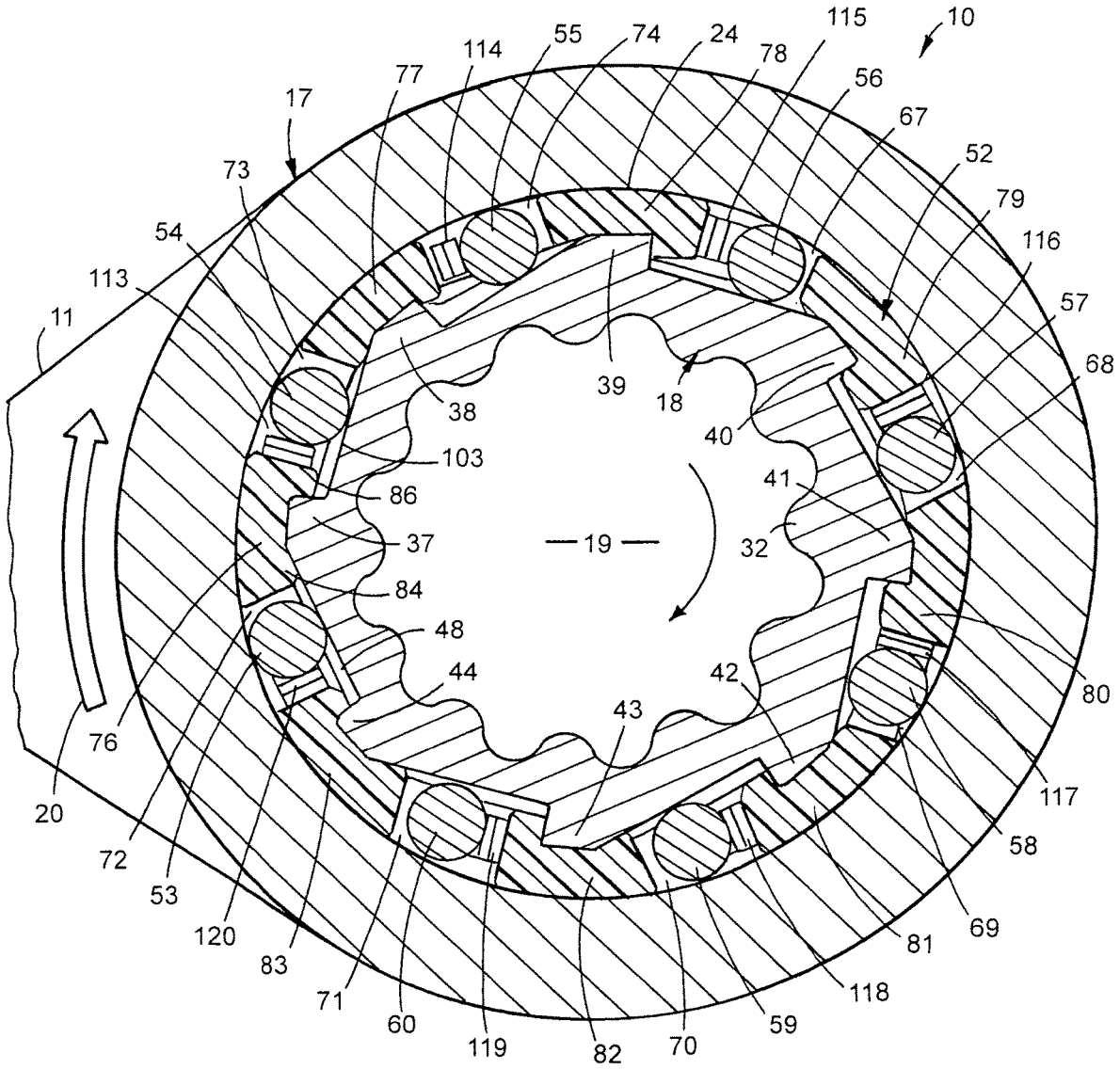
FIG. 27 is an enlarged sectional view taken along line 27-27 of FIG. 2.

Body 18, shown in FIGS. 12 to 14, is surrounded with an annular cage or sleeve 52 accommodating a plurality of wedging elements or members 53 to 61. Eight wedging members 53, 54, 55, 56, 57, 58, 59 and 60 are illustrated in FIG. 27. Each wedging member is illustrated as a metal cylinder roller, as shown in FIGS. 15 and 16. Wedging member 53 has a cylindrical outer surface 61 and flat opposite ends 62 and 63. Wedging member 54 to 61 have the same cylindrical shape as wedging member 53. The wedging members can have other configurations, such as oval, elliptical and polyhedral. The number of wedging members corresponds to the number of protrusions on body 18.

Figure 19:
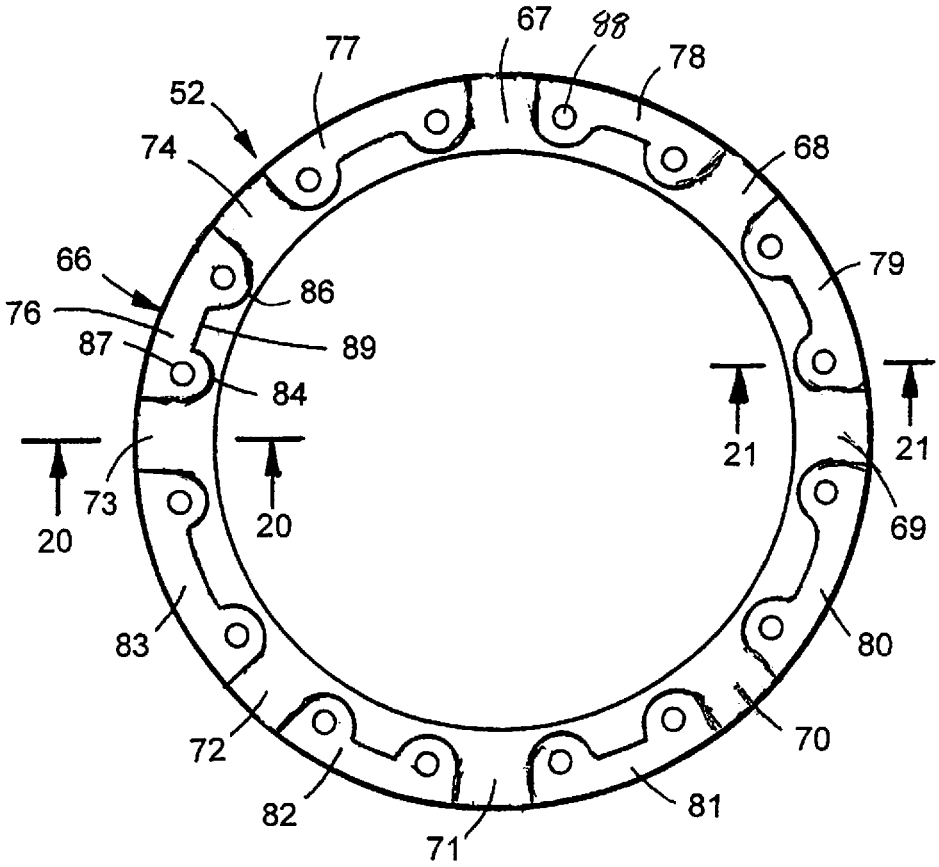
FIG. 19 is an enlarged bottom plan view of FIG. 17.
Figure 22:
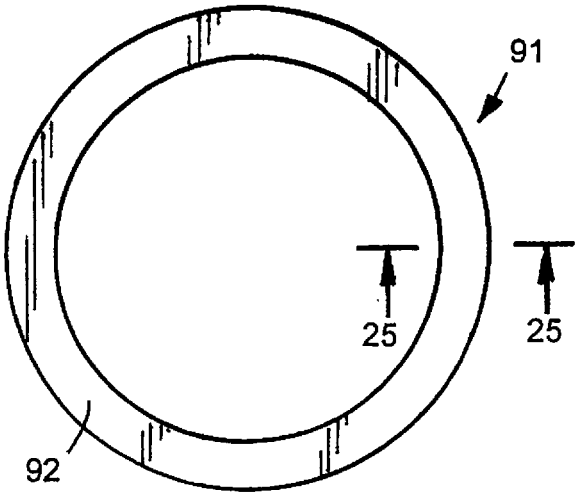
FIG. 22 is a top plan view of the second member of the roller cage.
Figure 25:
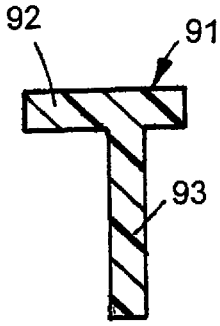
FIG. 25 is an enlarged sectional view taken along line 25-25 of FIG. 22.
Figure 23:
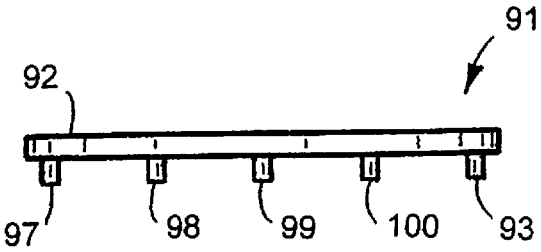
FIG. 23 is a bottom elevational of FIG. 22.

Cage 52 is an annular retainer for holding wedging members 53 to 60 in selected locations on ramps 48 of protrusions 37 to 44. Cage 52, shown in FIGS. 17 to 21, has a first annular member 64 with a circumferential side wall 66. A plurality of axial slots or rectangular openings 67, 68, 69, 70, 71, 72, 73 and 74 are evenly spaced around side wall 66. Eight openings are illustrated in FIG. 19. The number of openings 67 to 74 corresponds to the number of protrusions 37 to 44 on body 18. Side wall 66 has eight segments 76, 77, 78, 79, 80, 81, 82 and 83 separated by openings 67 to 74. Each segment has a pair of circumferentially spaced ribs 84 and 86 having blind holes 87 and 88. Ribs 84 and 86 project inwardly from the inside wall 89 of side wall 66.

Figure 26:
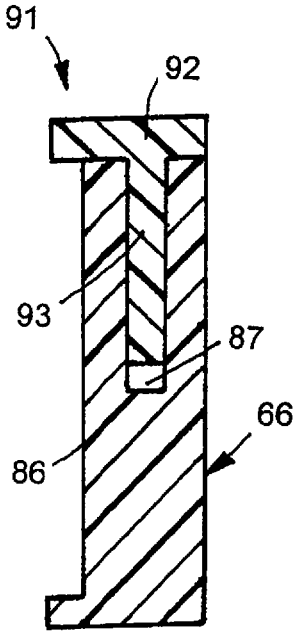
FIG. 26 is a sectional view showing the combined first and second members of the roller cage.
Figure 24:
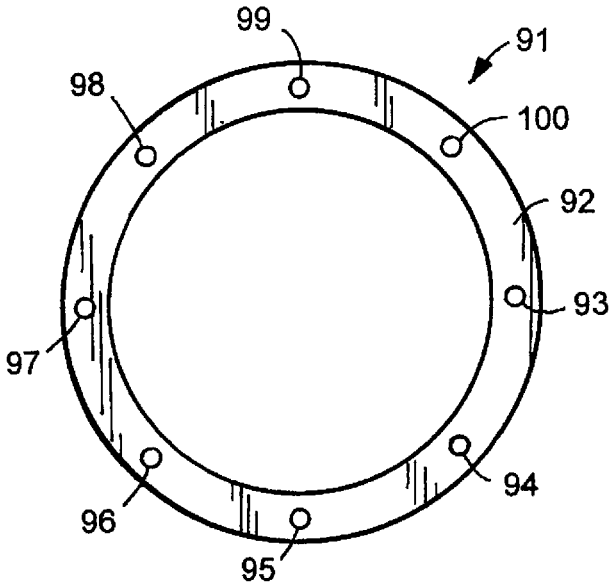
FIG. 24 is a bottom plan view of FIG. 22.

Cage 52, shown in FIGS. 22 to 25, has a second member 91 comprising a flat circular ring 92. A plurality of fingers or rods 93, 94, 95, 96, 97, 98, 99 and 100 project away form the bottom of ring 92. As shown in FIG. 26, first member 66 is joined to second member 91 by inserting rods 93 to 100 into one of the holes 87 and 88 of each segment 76 to 83 of side wall 66. An adhesive can be used to secure rods 93 to 100 of segments 76 to 83. Returning to FIGS. 13 and 14, wedging members 58, 59 and 60 are located in openings 70, 71 and 72.

Figure 28:
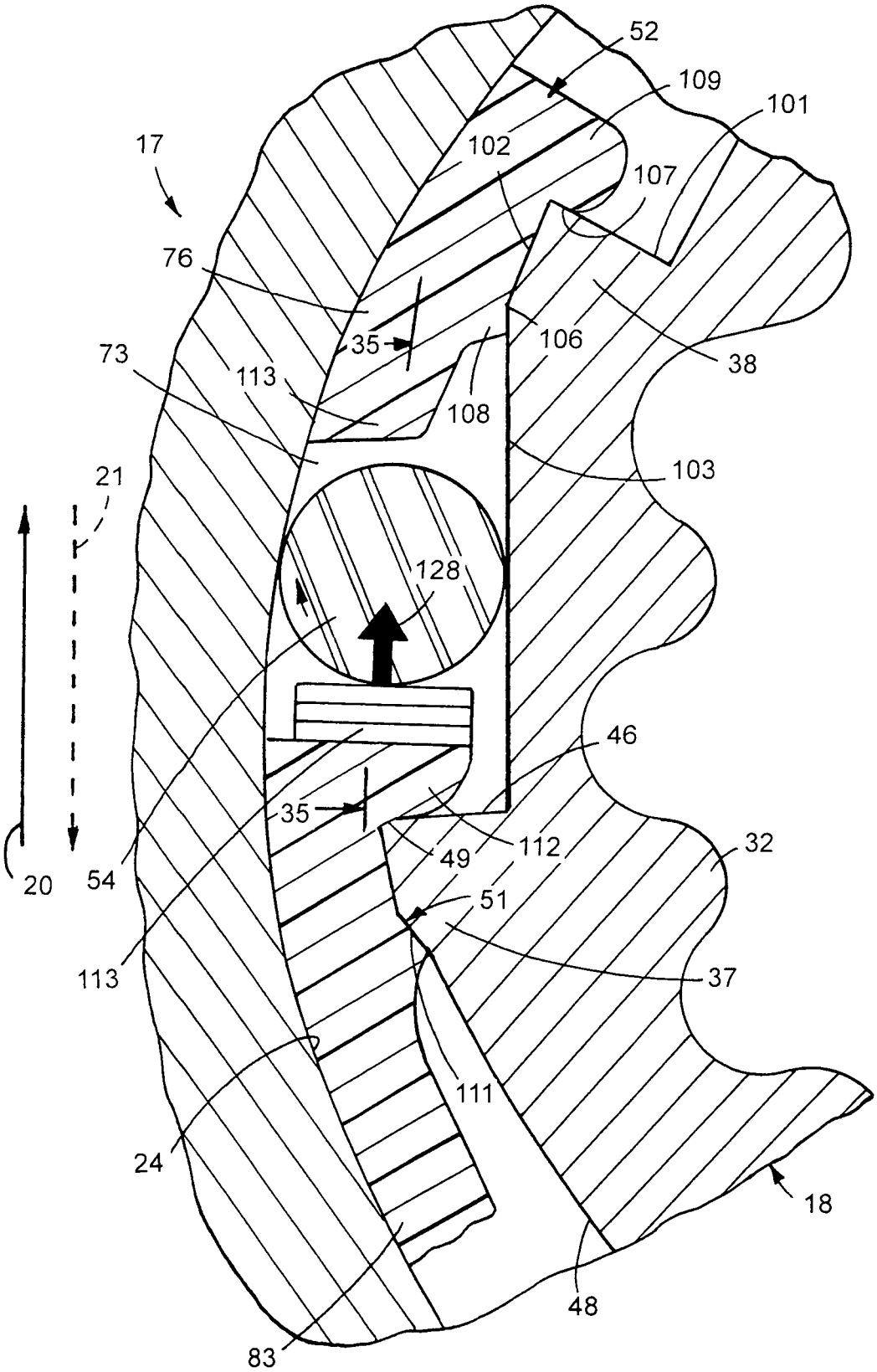
FIG. 28 is an enlarged sectional view of a section of the head of the wrench showing protrusions of the driven body, the cage, a roller and the cylindrical wall of the head.
Figure 30:
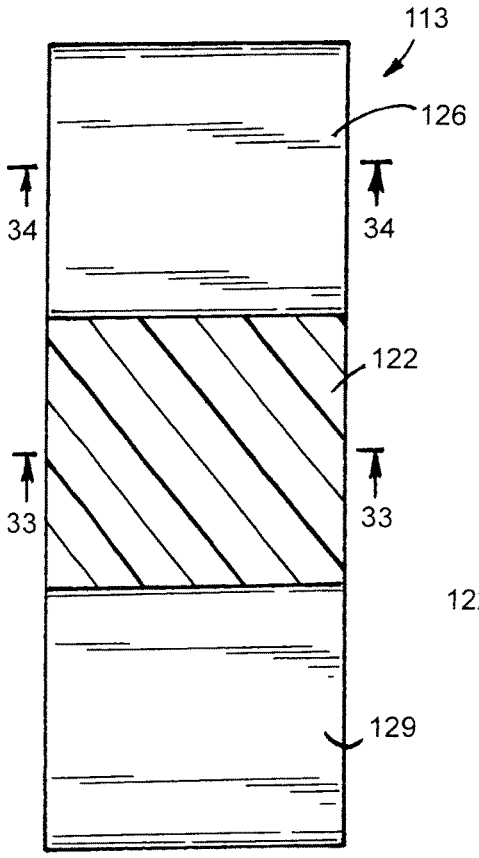
FIG. 30 is a left side elevational view of FIG. 29.
Figure 29:
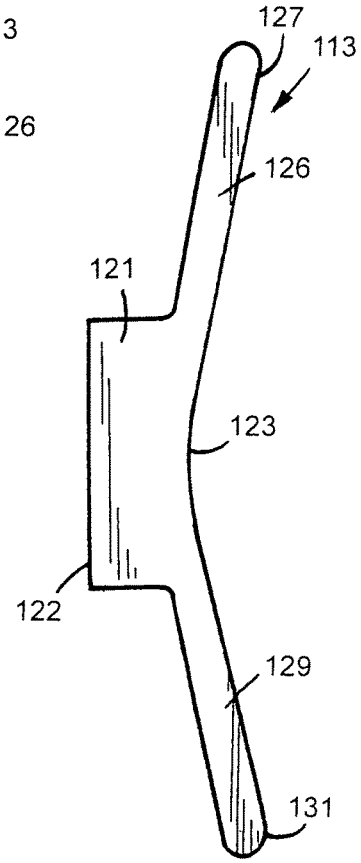
FIG. 29 is an elevational view of a retainer of FIG. 28 for holding a cylindrical roller in engagement with a ramp and cylindrical inside wall of the head.
Figure 31:
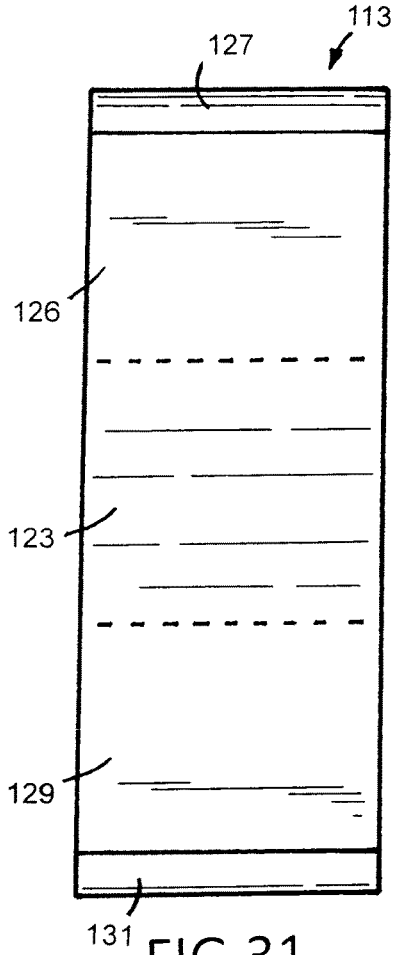
FIG. 31 is a right side elevational view of FIG. 29.
Figure 33:
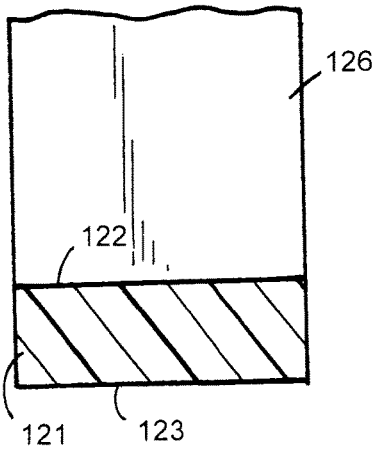
FIG. 33 is a sectional view taken along line 33-33 of FIG. 30.
Figure 32:
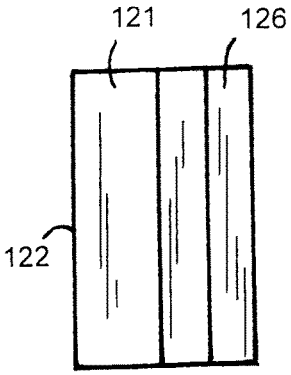
FIG. 32 is a top plan view of FIG. 29.
Figure 34:
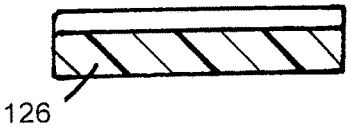
FIG. 34 is a sectional view taken along line 34-34 of FIG. 30.

As shown in FIG. 27, segments 76 to 83 of cage 52 have outer surfaces located in sliding contiguous surface engagement with the cylindrical inside wall 24 of head 17 to locate cage 52 concentric with the axis 30 of head 17. A lubricant can be interposed as a film between the outer surfaces of segments 76 to 83 and cylindrical inside wall 24 of head 17. For example, a molybdenum and polytetrafluouroethylene lubricant can be used to prevent rust, binding, sticking and squeaking of body 18 during use of wrench 10. Cage 52 is anchored on body 18 to prevent rotation of cage 52 relative to body 18 and locate wedging elements 53 to 60 in engagement with the ramps of protrusions 37 to 44 and cylindrical wall 24 of head 17. As shown in FIG. 28, protrusion 38 has a radial shoulder 101, a ridge 102 and a ramp 103. Ridge 102 has corners 106 and 107 at its opposite ends. Ribs 108 and 109 engage corners 106 and 107 to anchor cage 52 to protrusion 38. Corners 49 and 51 of protrusion 37 are in engagement with ribs 111 and 112 on segment 83 of cage 52. Each of segments 76 to 83 has a pair of ribs that are anchored on protrusions 37 to 44 as illustrated in FIGS. 27 and 28. Different structures can be used to anchor cage 52 to protrusions 37 to 44 or body 18.

Wedging member 54, shown in FIG. 28 as a cylindrical roller, located in slot 73 between segments 76 and 83 is adjacent cylindrical inside surface 24 of head 17 and ramp 103. Segments 76 and 83 have outwardly directed side walls 113 and 114 that allow wedging member 54 to rotate and radially move from engaging positions into wedging positions with the cylindrical inside surface 24 of the head 17 and ramp 103 when handle 11 and head 17 are moved in a clockwise direction, shown by arrow 20, whereby torque is applied to body 18 to rotate body 18 with head 17. The contact of wedging member 54 in the engaging position and the moving cylindrical inside wall 24 of head 17 rotates wedging member 54 in a clockwise direction and rolls wedging member 54 up ramp 103 to a wedging position that transmits torque or force from head 17 to body 18. When head 17 is turned in the reverse direction or counterclockwise, shown by broken line arrow 21, wedging member 54 in contact with cylindrical surface 24 of head 17 rotates in a counterclockwise direction and down ramp 103, shown in broken lines, to a non-wedging or torque release position. Handle 11 and head 17 are rotated in a reverse direction, shown by arrow 21, without rotating body 18. Wedging members 53 to 60 are concurrently moved into wedging or driving engagement with the cylindrical inside side wall 24 of head 17 and ramps on protrusions 37 to 44 when the head 17 and handle 11 are moved in a clockwise direction to rotate body 18. When the head 17 and handle 11 are moved in a reverse or counterclockwise direction wedging members 53 to 60 concurrently move to non-wedging or torque release positions without rotating body 18.

As shown in FIG. 27, the cylindrical rollers 53 to 60 are held in contact or engaging positions between the ramps and cylindrical inside wall 24 of head 17 with retainers 113, 114, 115, 116, 117, 118, 119 and 120. The retainers 113 to 120 interposed in the openings or slots 67 to 73 in cage 52 contact the cage 52 and cylindrical rollers 53 to 60 and hold the rollers 53 to 60 in their engaging positions with the ramps and cylindrical inside wall 24 of head 17.

Figure 35:
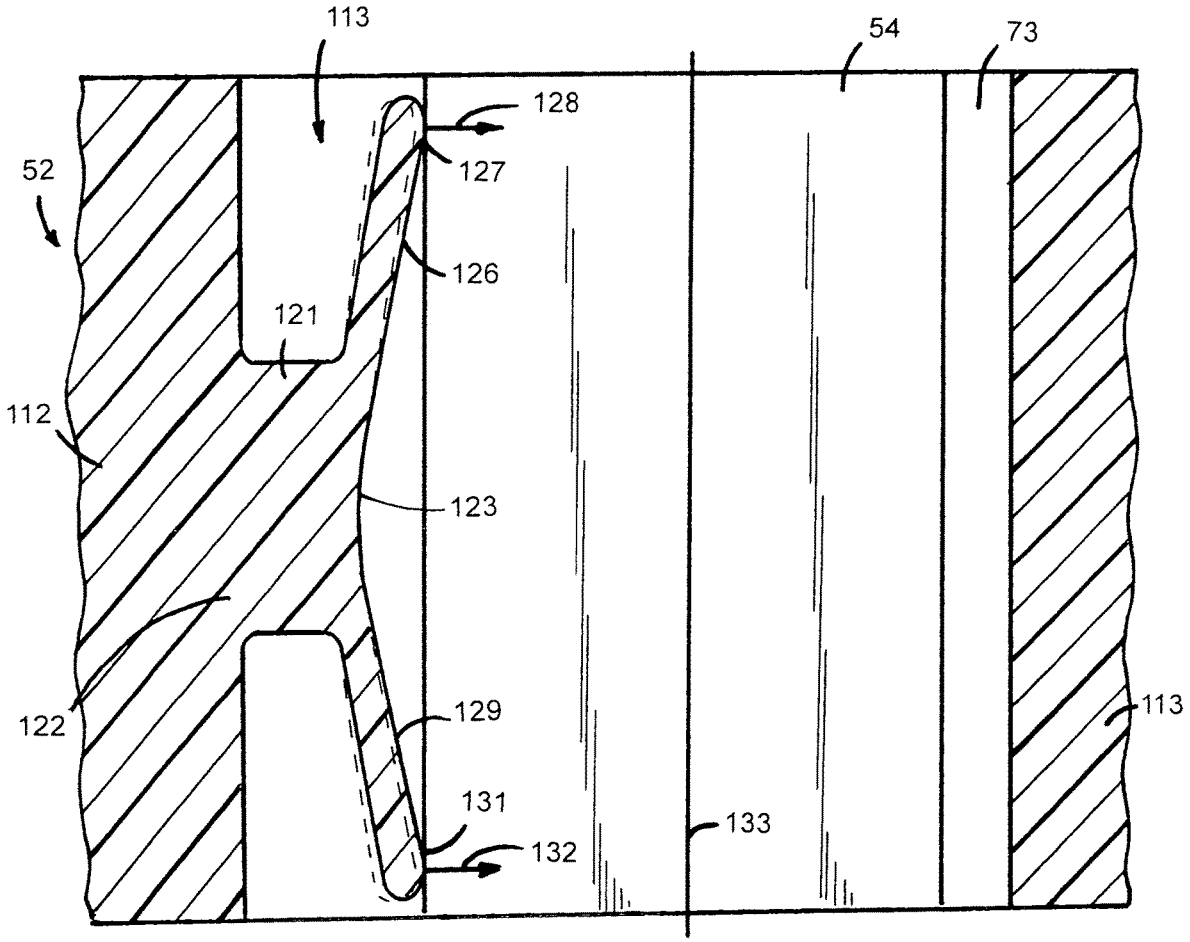
FIG. 35 is an enlarged sectional view taken along line 35-35 of FIG. 28.
Figure 36:
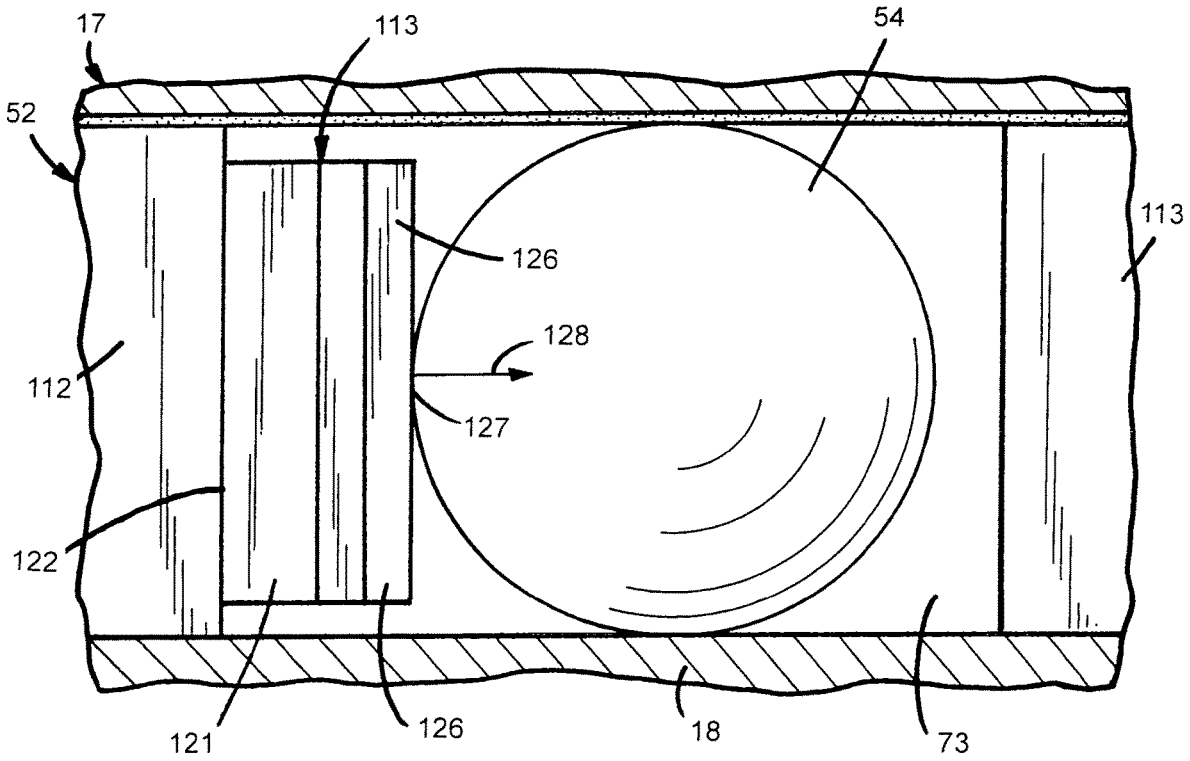
FIG. 36 is a top plan view of FIG. 35.

Retainers 113 to 120 are identical structure and functional pusher members. Retainer 113, illustrated in FIGS. 29 to 34, has the same structure and biasing force as each of retainers 114 to 120. Retainer 113 has a body or boss 121 having a rear wall 122 and a front wall 123. A flat first arm 126 extends upwardly and laterally outward from one end of wall 123. Arm 126 is inclined laterally at an angle of 10 degrees relative to the flat plane of wall 123. Arm 126 can be inclined at other angles relative to the front wall 123. The outside outer end of arm 126 has a flat surface 127. A second arm 129 extends downwardly and laterally outward from wall 123. Arm 129 is inclined laterally at an angle of 10 degrees relative to the flat plane of wall 123. Arm 129 can be inclined at other angles relative to wall 123. Arms 126 and 129 are inclined at the same angles relative to flat wall 122 of boss 121. Also, arms 126 and 129 have the same length, width, thickness and elastic properties. The outside outer end of arm 129 has a flat surface 131. Flat surfaces 127 and 131 of arms 126 and 129 are located in the same plane which is parallel to the plane of flat rear wall 122 of boss 121. Retainer 113 is a one-piece member made of elastic material including an elastic plastic or metal. Arms 126 and 129 can include linear elongated fibers incorporated in the plastic material to increase the elastic strength of arms 126 and 129. As shown in FIG. 35, retainer 113 is joined to cage 52.

Outer flat surfaces 127 and 131 of arms 126 and 129 engage opposite end portions of cylindrical roller 54. Arms 126 and 129 bias with equal elastic force the cylindrical roller 54 laterally and perpendicular to axis 133 of cylindrical roller 54, as shown by arrows 128 and 132 in FIG. 35.

Retainers 113 to 120 maintain all of cylindrical rollers 53 to 60 in contact or engaging positions with respect to the ramps and cylindrical inside wall 24 of head 17. In use when handle 11 is turned in an arcuate direction, shown by arrow 20 in FIGS. 1, 3, 27 and 28, all of the cylindrical rollers 53 to 60 concurrently shift from their engaging positions to driving or wedging positions relative to the ramps and cylindrical inside wall 24 of head 17 whereby the torque applied to handle 11 is transmitted to body 18 to rotate the fastener associated with body 18. Moving handle 11 in an opposite arcuate direction, shown by arrow 21 in FIG. 28, shifts cylindrical rollers 53 to 60 back from the wedging positions to the engaging positions with respect to the ramps and cylindrical inside wall 24 of head 17. The reverse arcuate movement is minimal whereby the wrench can function in space restrictive environments.

Figure 37:
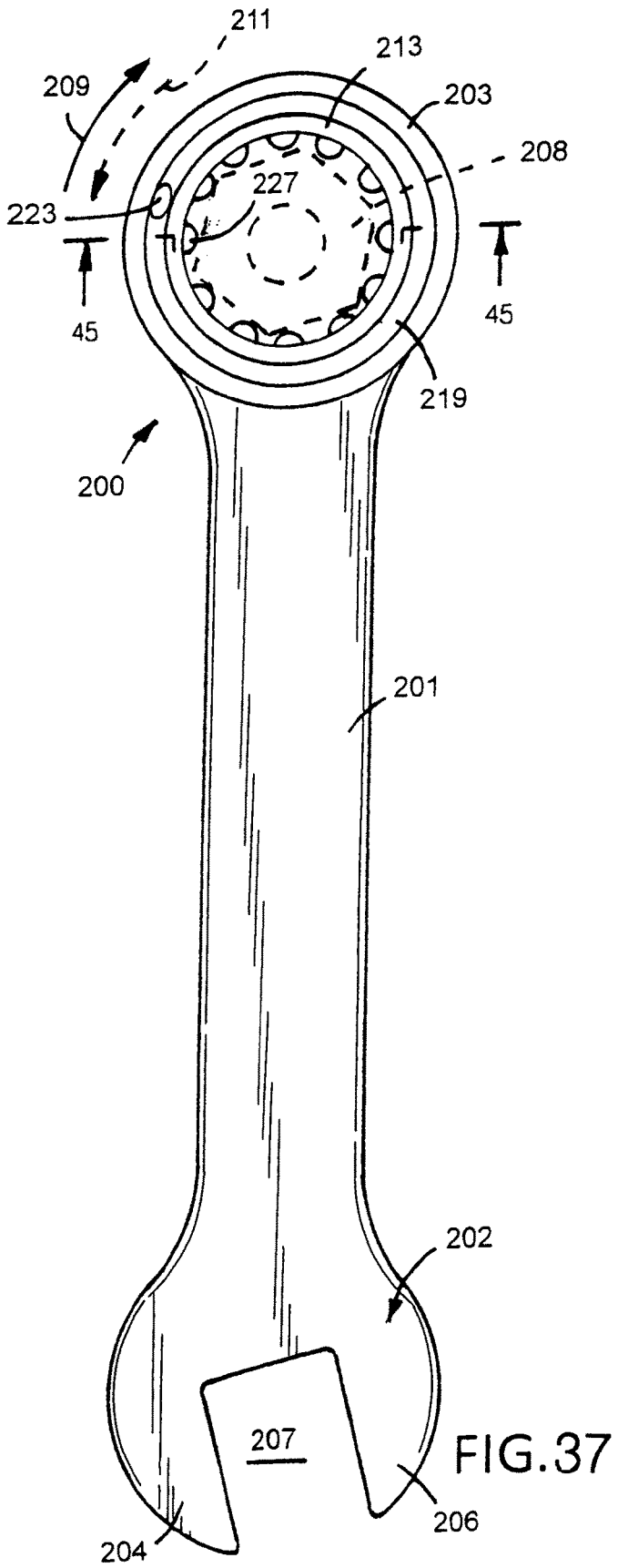
FIG. 37 is a front elevational view of a second embodiment of the combination box and roller wrench of the invention.
Figure 38:
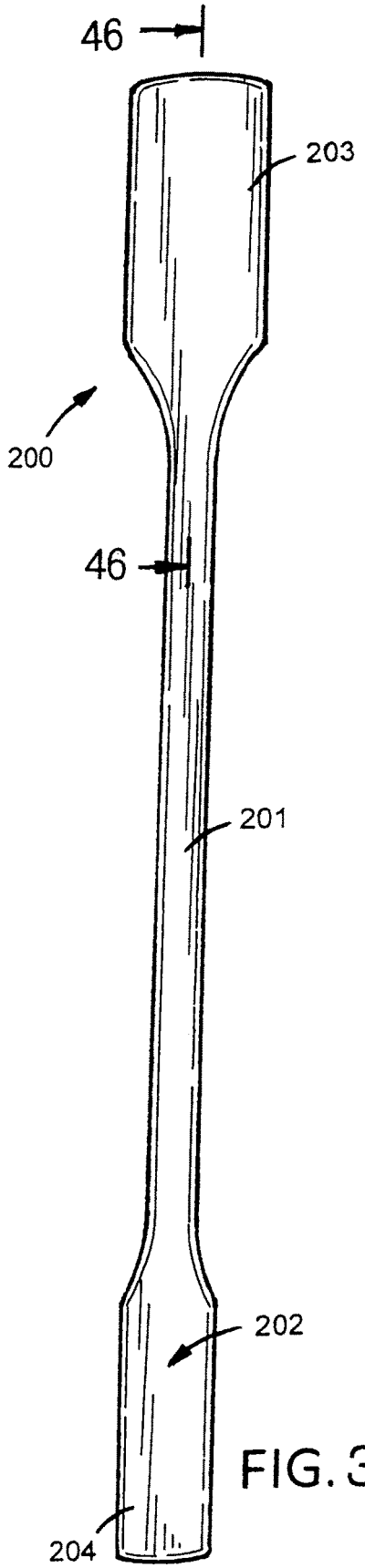
FIG. 38 is a left side view of FIG. 37.

The hand tool, shown in FIGS. 37 to 56, is a second embodiment of a combination box and roller wrench 200. The wrench 200 is illustrated as one size of seven wrenches. The seven piece combination wrenches have metric sizes 8, 10, 12, 13, 14, 15 and 17 mm and SAE sizes 15/16, 3/8, 7/16, 1/2, 9/16, 5/8 and 3/4 inch. The wrenches can have additional sizes. Wrench 200 comprises a linear handle 201, a box end 202 and a roller end or cylindrical head 203. Box end 202 has laterally spaced jaws 204 and 206 surrounding an opening 207 for accommodating a conventional nut or bolt or screw head. Handle 201, box end 202 and head 203 are a one-piece metal structure. Head 203 can be pivotally connected to an end of handle 201 to provide a flex-head combination wrench. In use, head 203 engages a fastener 208, such as a nut or a head of a bolt or screw. As shown in FIG. 37, when handle 201 is angularly turned clockwise, shown by arrow 209, a right hand fastener 208 is threaded on to a threaded member. Turning handle 201 in a counterclockwise direction, shown by arrow 211, turns fastener off of the threaded member.

Figure 45:
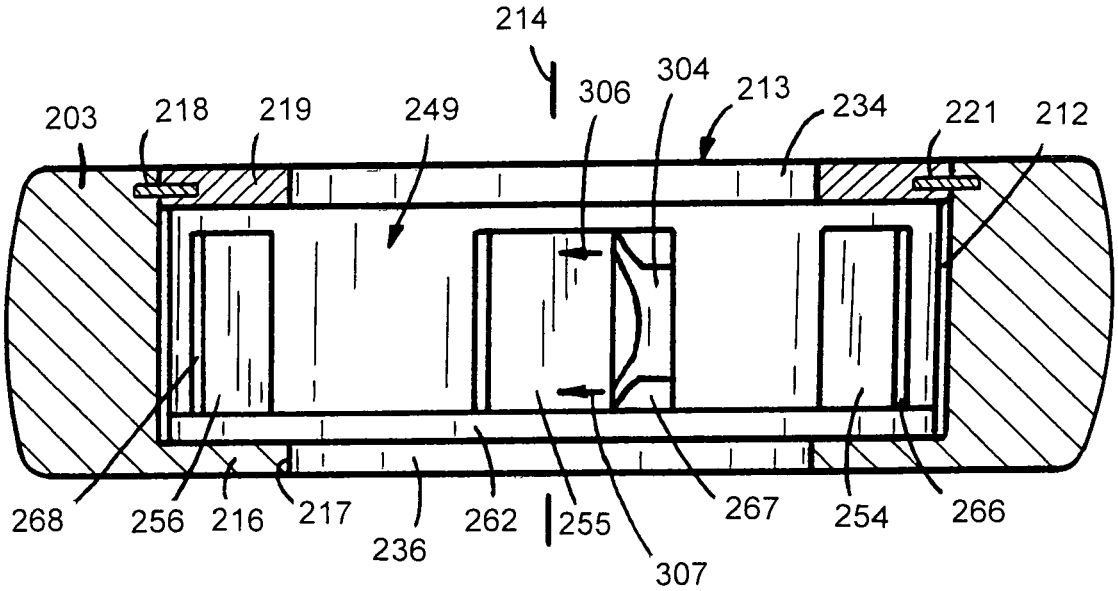
FIG. 45 is an enlarged sectional view taken along the line 45-45 of FIG. 37.

As shown in FIGS. 37 and 45, head 203 is a generally cylindrical member having flat top and bottom surfaces and a cylindrical inside wall 212 surrounding an opening 226 accommodating a driven member or body 213. Wall 212 has a continuous cylindrical surface concentric with the axis 214 of cylindrical inside wall 212 of head 203. Head 203 includes an annular lip or flange 216 surrounding an opening 217. The upper cylindrical wall 212 has an annular groove or recess 218. A flat annular member or ring 219 is attached to head 203 with a C-shaped spring 221. Spring 221 extends into groove 218 in head 203 and an annular groove 222 in ring 219. As shown in FIG. 37, ring 219 has an aperture 223 that allows the ring 219 to be contracted to allow the C-spring to be inserted into groove 218. Ring 219 engages body 213 to retain body 213 in a rotational relationship with head 203.

Figure 39:
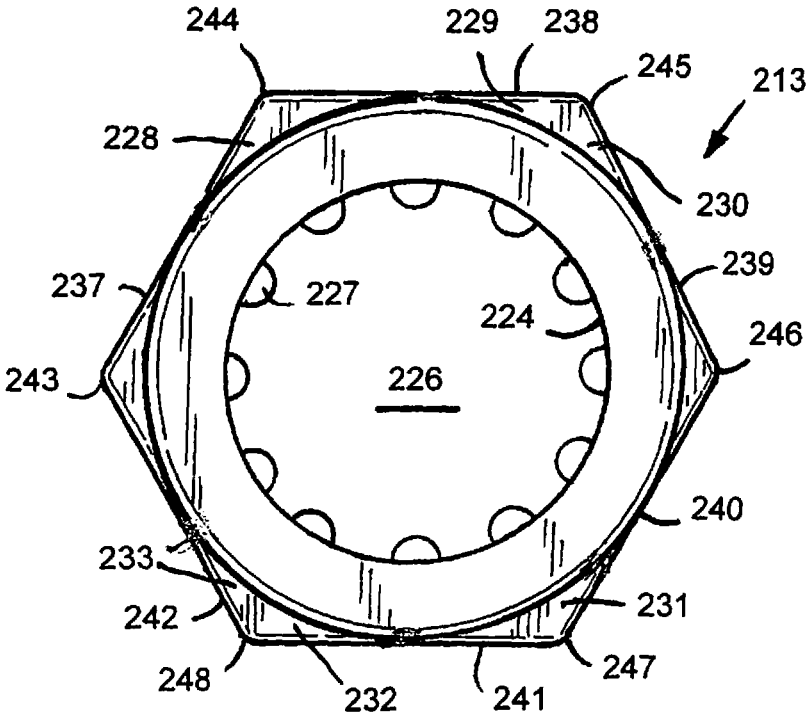
FIG. 39 is an enlarged top plan view of the driven member of the wrench of FIG. 37.
Figure 40:
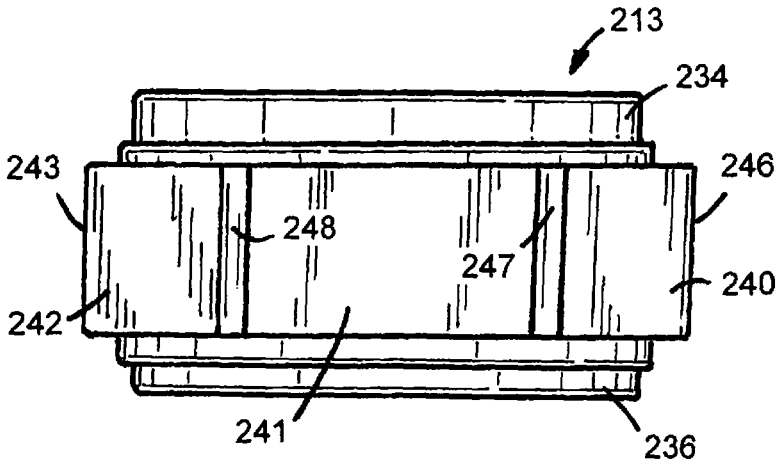
FIG. 40 is a bottom elevational view of FIG. 39.

Proceeding to FIGS. 39 and 40, body 213 has a cylindrical inside wall 224 surrounding an opening 226 to accommodate fastener 208. A plurality of circumferentially spaced elongated teeth or ribs 227 joined to wall 224 extend radially into opening 226. Adjacent ribs 227 are circumferentially spaced from each other providing grooves and recesses to accommodate corner portions of the hexagonal fastener 208 or corner portions of a square fastener to driveably couple body 213 with the fastener. The illustrated embodiments, shown in FIG. 41, have twelve ribs. The number, size and configuration of the ribs can vary. The inside wall 224 of body 213 can have a hexagonal shape without ribs to accommodate a hexagonal fastener.

Figure 46:
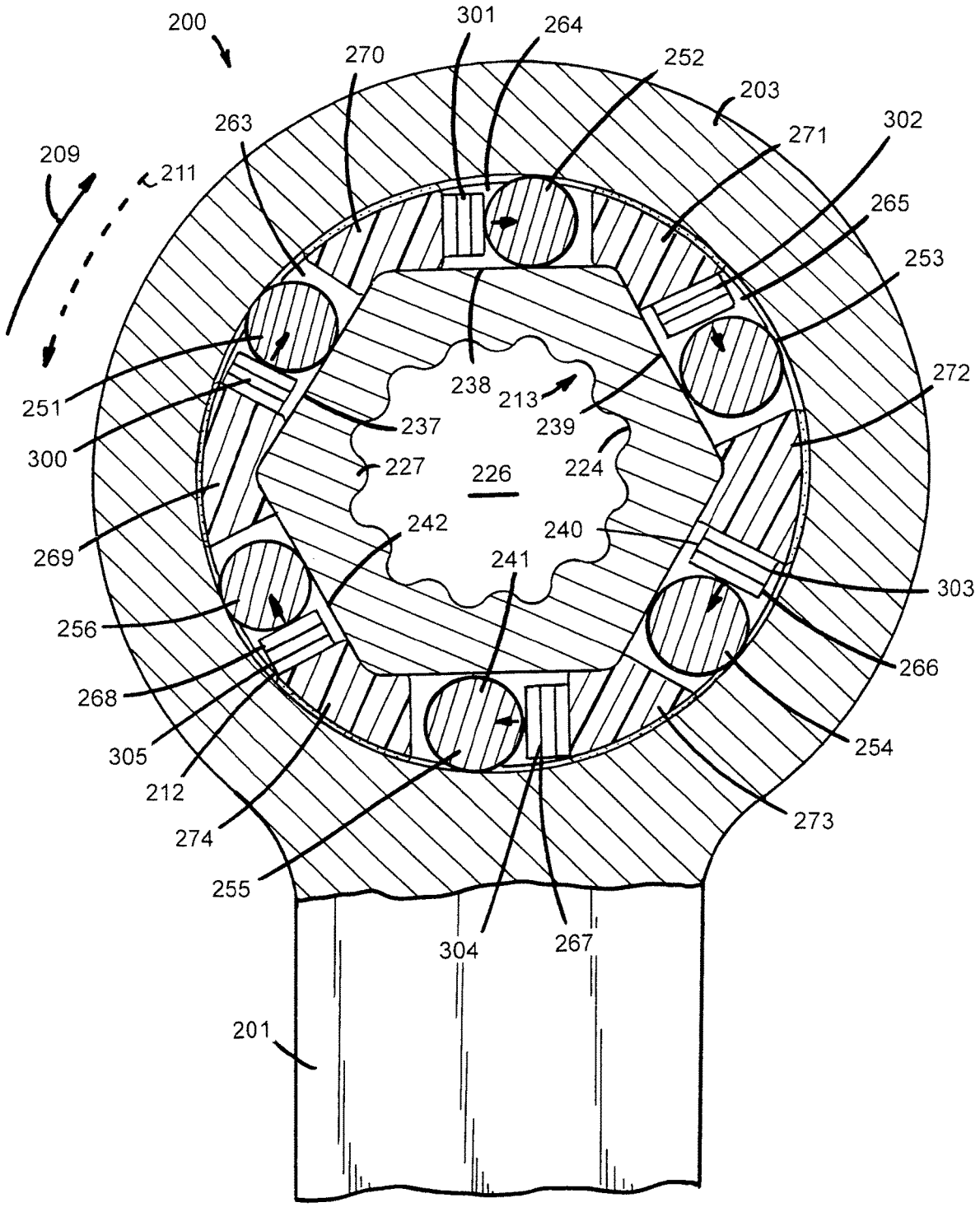
FIG. 46 is an enlarged sectional view taken along the line 46-46 of FIG. 38.

As shown in FIGS. 40 and 45, body 213 has an upper cylindrical sleeve 234 and a lower cylindrical sleeve 236. Ring 219 surrounds sleeve 234. Sleeve 236 is located in opening 217 of lip 216. Sleeves 234 and 236 limit lateral movements of body 213 relative to head 203 and allow rotational movement of head 203 relative to body 213. As shown in FIGS. 39 and 46, body 213 has six protrusions or sections 228, 229, 230, 231, 232 and 233 having a perimeter hexagonal configuration. Protrusions 228 to 233 have flat rectangular outer faces or ramps 237, 238, 239, 240, 241 and 242. Each ramp 237 to 242 is tangent to a circle having a center at the axis 214 of body 213 and head 203. Ramps 237 to 242 have the same lengths and widths. The length of each ramp is two times its width. The ramps can have other dimensions. Ridges 243, 244, 245, 246, 247 and 248 are located at the outer ends of ramps 237 to 242. Ridges 243 to 248 are corners or apex members between adjacent ramps.

Figure 41:
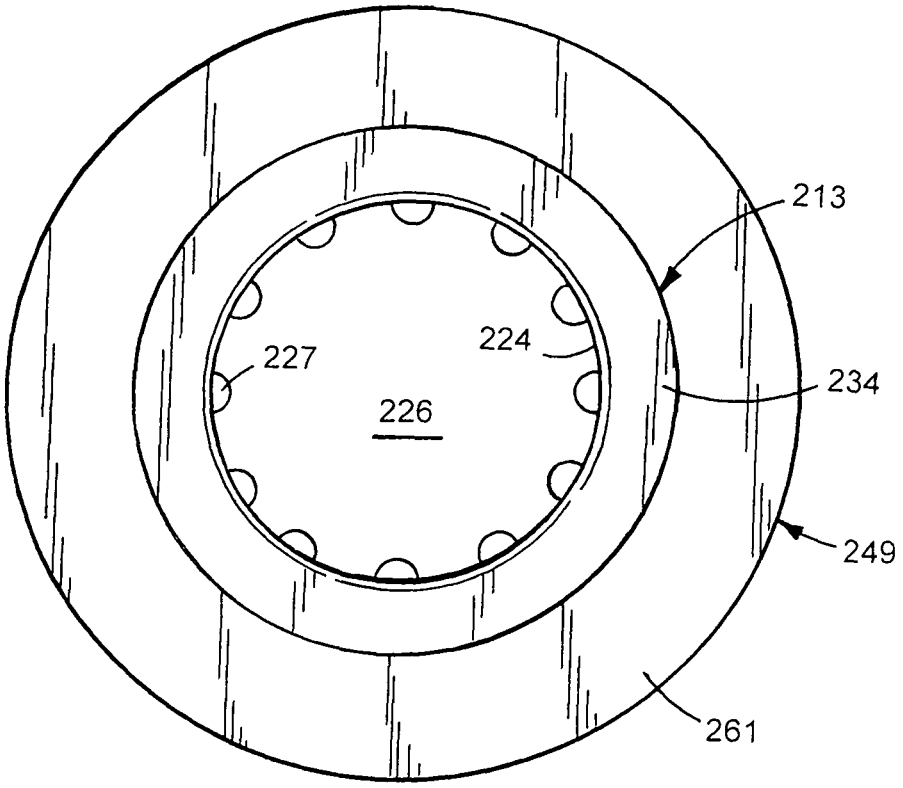
FIG. 41 is an enlarged top plan view of the combined annular cage and driven member of the wrench of FIG. 37.
Figure 42:
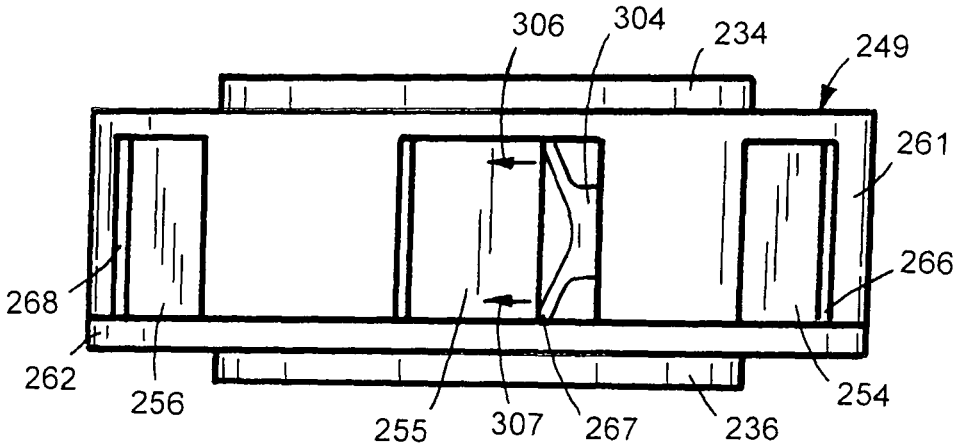
FIG. 42 is a bottom elevational view of FIG. 41.
Figure 43:
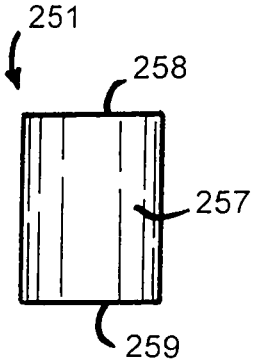
FIG. 43 is a front elevational view of a cylindrical roller of the wrench of FIG. 37.
Figure 44:
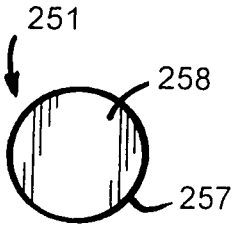
FIG. 44 is an end view of FIG. 43.

Body 213, shown in FIGS. 41, 42 and 45, is surrounded with an annular cage assembly or sleeve 249 accommodating a plurality of wedging elements or members 251, 252, 253, 254, 255 and 256. The wedging members comprise metal cylindrical rollers. A cylindrical roller 251, shown in FIGS. 43 and 44, has a continuous cylindrical outside wall 257 and flat and circular end walls 258 and 259. End walls 258 and 259 have flat parallel surfaces. The axial length of roller 251 is greater than its diameter. The length to diameter ratio of the rollers can vary with the size of the wrench 200. Rollers or wedging members 252, 253, 254, 255 and 256 have the same dimensions as roller 251. The wedging members can have other configurations, such as oval, elliptical and polyhedral. The number of wedging members corresponds to the number of ramps on body 213.

Figure 47:
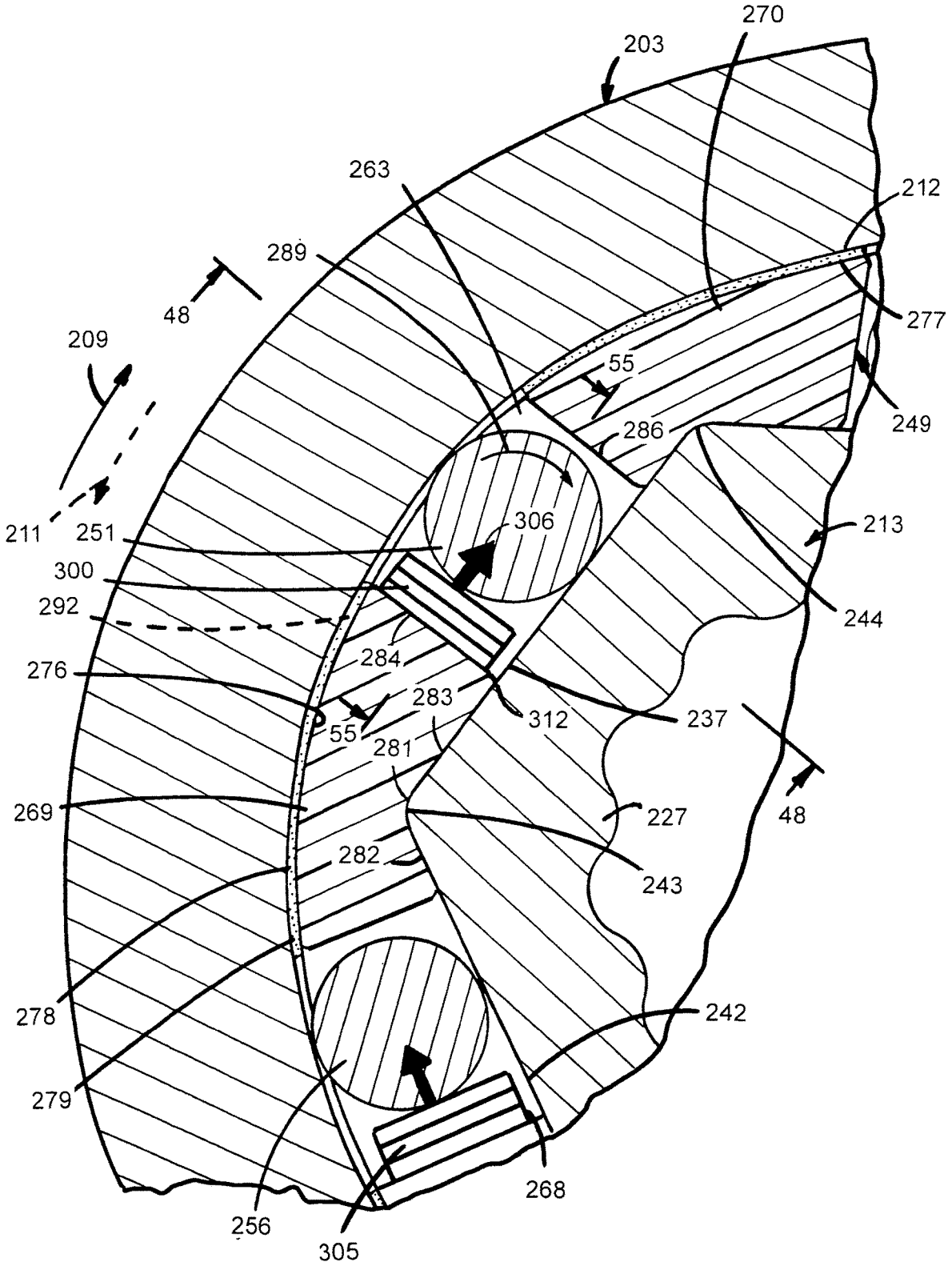
FIG. 47 is an enlarged section of FIG. 46.

Returning to FIGS. 42, 45 and 46, cage assembly 249 has a first annular member 261 joined to a second annular member 262. Annular member 261 has a plurality of axial slots or rectangular openings 263, 264, 265, 266, 267 and 268 circumferentially spaced around annular member 261. Six openings are illustrated in FIG. 46. The number of openings in annular member 261 can vary. The number of openings 263 to 268 corresponds with the number of ramps 237 to 242. Annular member 261 has six segments 269, 270, 271, 272, 273 and 274 circumferentially spaced around annular member 261. One of the openings 263 to 268 is located between each adjacent segment. Wedging members 251 to 256, shown as cylindrical rollers, located in openings 263 to 268 selectively engage and disengage inside cylindrical wall 224 and ramps 237 to 242. As shown in FIG. 47, segment 269 has an arcuate outside wall 276. Segment 270 also has an arcuate outside wall 277. Each segment 271 to 274 has an arcuate outside wall the same as arcuate outside walls 276 and 277. The arcuate outside walls 276 and 277 and arcuate outside walls of segments 271 to 274 are located in contiguous relation 278 relative to cylindrical inside wall 212 of head 203. The arcuate outside walls of segments 269 to 274 are in close proximity with the inside wall 212 of head 203 to locate cage assembly 249 concentric with the axis of head 203. A lubricant 279 is located as a film on the inside cylindrical wall 212 of head 203 or in the outside arcuate walls of segments 269 to 274. For example, a molybdenum and polytetrafluoroethylene lubricant can be used to prevent rust, binding, sticking and squeaking during use of the wrench 200.

Proceeding to FIG. 47, segment 269 of cage assembly 249 has an inside obtuse angle recess or groove 281 accommodating the ridge 243 of body 213. Each segment 270 to 274 has an obtuse angle groove corresponding to groove 281 in segment 269. The ramp portions adjacent ridge 243 located in surface engagement with the inside walls 282 and 283 of segment 269 prevent rotation of cage assembly 249 relative to body 213 and position the locations of openings 263 to 268 relative to ramps 237 to 242. Cage assembly 249 is anchored on body 213. Segment 269 has a side wall 284. Segment 270 has a side wall 286. Side walls 284 and 286 extend outwardly and are circumferentially spaced from each other to provide opening 263. Adjacent segments have side walls corresponding to side walls 284 and 286 providing openings 264 to 268 in the cage assembly 249 for wedging members 252 to 256.

Figure 48:
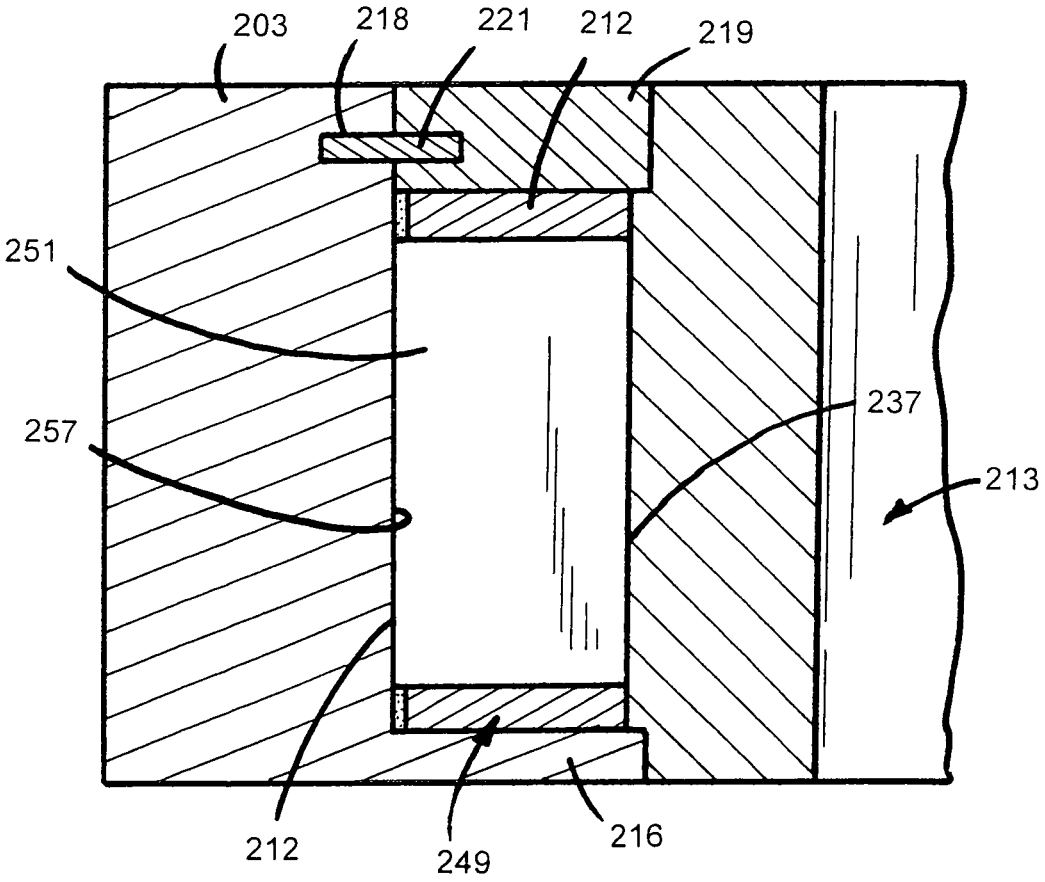
FIG. 48 is a sectional view taken along the line 48-48 of FIG. 47.
Figure 50:
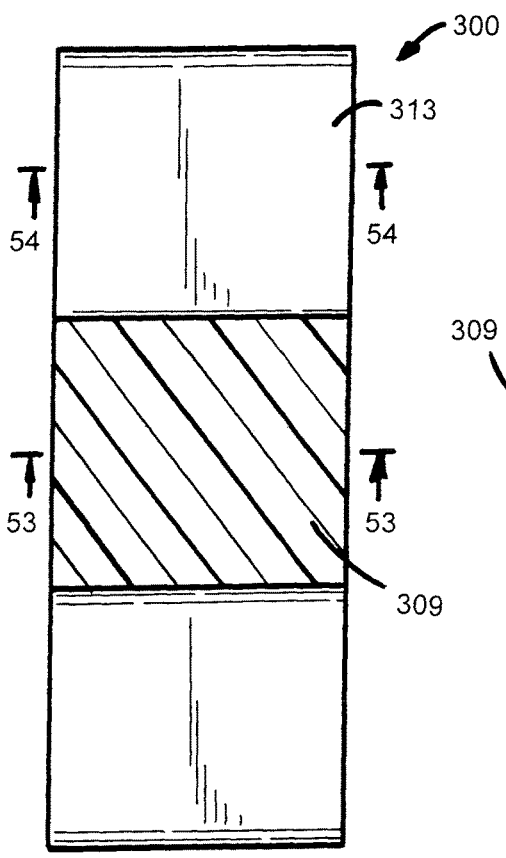
FIG. 50 is a left side elevational view of FIG. 49.
Figure 49:
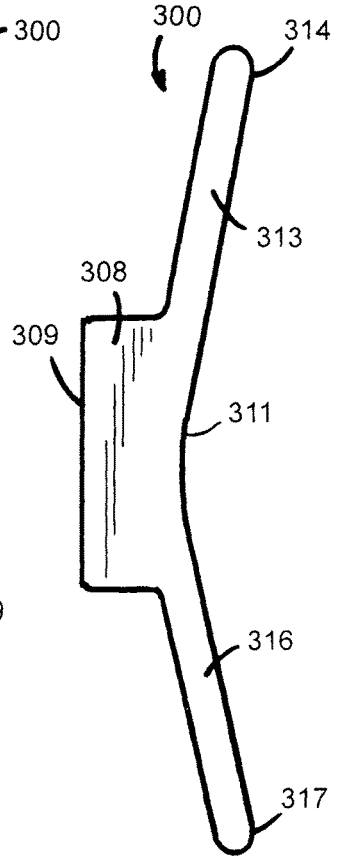
FIG. 49 is an elevational view of a retainer of FIG. 47 for holding a cylindrical roller in engagement with a ramp and cylindrical inside wall of the head.
Figure 51:
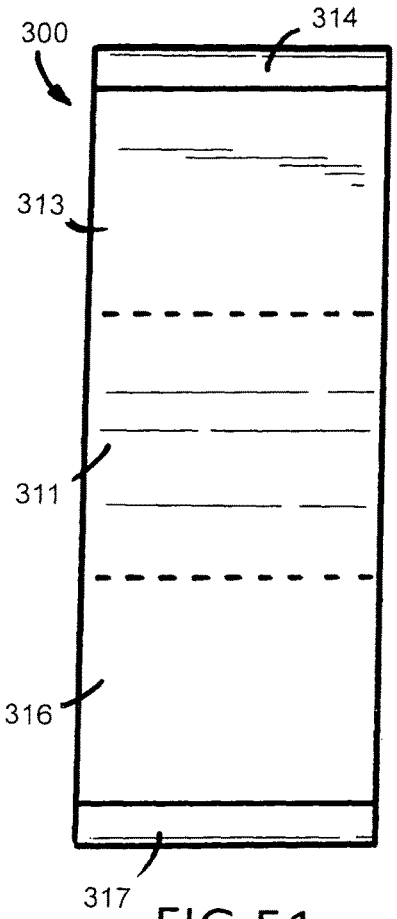
FIG. 51 is a right side elevational view of FIG. 49.
Figure 53:
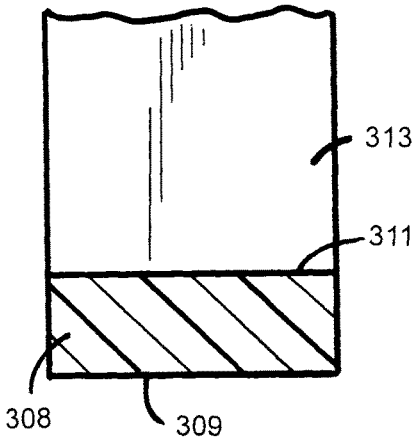
FIG. 53 is a sectional view taken along line 53-53 of FIG. 50.
Figure 52:
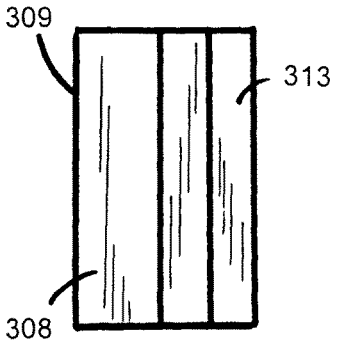
FIG. 52 is a top plan view of FIG. 49.
Figure 54:
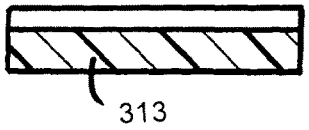
FIG. 54 is a sectional view taken along line 54-54 of FIG. 50.

The wedging member 251, shown as a cylindrical roller in FIG. 48, has a side wall 257 located in linear engagement with the inside wall 212 of head 203 and ramp 237 of body 213. The linear engagement of wedging member 251 is continuous along the entire axial length of wedging member 251. The flat ends 258 and 259 of wedging element 251 located in sliding contact with flat surfaces 287 and 288 of cage assembly 249 maintain side wall 257 of wedging member 251 parallel to the side wall 212 of head 203 and ramp 237 of body 213. Wedging members 252 to 256 have the same structure as wedging member 251 and linear relation relative to the side wall 212 of head 203 and ramps 238 to 242.

Returning to FIG. 47, cage assembly segments 269 and 270 have outwardly extended side walls 284 and 286 on opposite sides of opening 263 that allow wedging member 251 to rotate, shown by arrow 289, and radially move from a ramp and inside wall engaging position into a wedging or driving engagement with the cylindrical wall 212 of head 203 and ramp 237 when handle 201 and head 203 are moved in a clockwise direction, shown by arrow 209, whereby torque is applied to body 213 to rotate body 213 with head 203. Wedging member 251 rolls along ramp 237 clockwise away from the center 291 of ramp 237 to drivably couple head 203 to body 213. When head 203 and handle 201 are turned in the reverse or counterclockwise direction, shown by broken line arrow 211, wedging member 251 rotates in a counterclockwise direction to a non-wedging or torque release position whereby body 213 is not rotated. Wedging members 252 to 256 along with wedging member 251 are concurrently moved from their engaging positions on ramps 237 to 242 and cylindrical inside wall 212 of head 203 to driving wedge engagement positions with side wall 212 of head 203 and ramps 237 to 242 when the head 203 and handle 201 are moved in a clockwise direction to rotate body 213. When the head 203 and handle 201 are moved in a counterclockwise direction wedging members 251 to 256 concurrently move back to a non-wedging or torque release positions without rotating body 213.

As shown in FIG. 46, retainers 300, 301, 302, 303, 304 and 305 located in cage slots 263 to 268 contact wedging members 251 to 256 and cage segments 269 to 274 and hold wedging elements 251 to 256 in engaging positions on ramps 237 to 242 and cylindrical inside wall 212 of head 203. Wedging members 251 to 256 are illustrated as cylindrical rollers. Retainers 300 to 305 apply biasing forces on each wedging member 251 to 256, shown by arrows 306 and 307 in FIGS. 46, 47 and 55 to continuously push and hold wedging members 251 to 256 to maintain their engaging positions on ramps 327 to 242 and cylindrical inside wall 212 of head 203.

Retainers 300 to 305 are identical structure and functional pusher members. Retainer 300, illustrated in FIGS. 49 to 54, has the same structure and biasing force as each of the retainers 301 to 305. Retainer 300 has a boss 308 having rectangular cross section, a rear wall 309 and a front wall 311. A flat first arm 313 extends upwardly and laterally outward from a first end of wall 311. Arm 313 is inclined laterally at an angle of 10 degrees relative to the flat plane of front wall 311. Arm 313 can be inclined at other angles relative to the plane of front wall 311. The outside outer end of arm 313 has flat surface 314. A second arm 316 extends downwardly and laterally outward from a second end of top wall 311. Arm 316 is inclined laterally at an angle of 10 degrees relative to flat outside wall 309 of boss 308. The inclined angle of arm 316 is 160 degrees clockwise from the inclined angle of arm 313. Arms 313 and 316 have the same length, width, thickness and elastic properties. The outside outer end of arm 316 has a flat surface 317. Flat surfaces 314 and 317 of arms 313 and 316 are located in the same plane which is parallel to the plane of front wall 311 of boss 308. Retainer 300 is a one-piece member made of elastic material including an elastic plastic or metal. Plastic arms 313 and 316 can include linear elongated fibers incorporated in the plastic material to increase the strength of arms 313 and 316.

Figure 55:
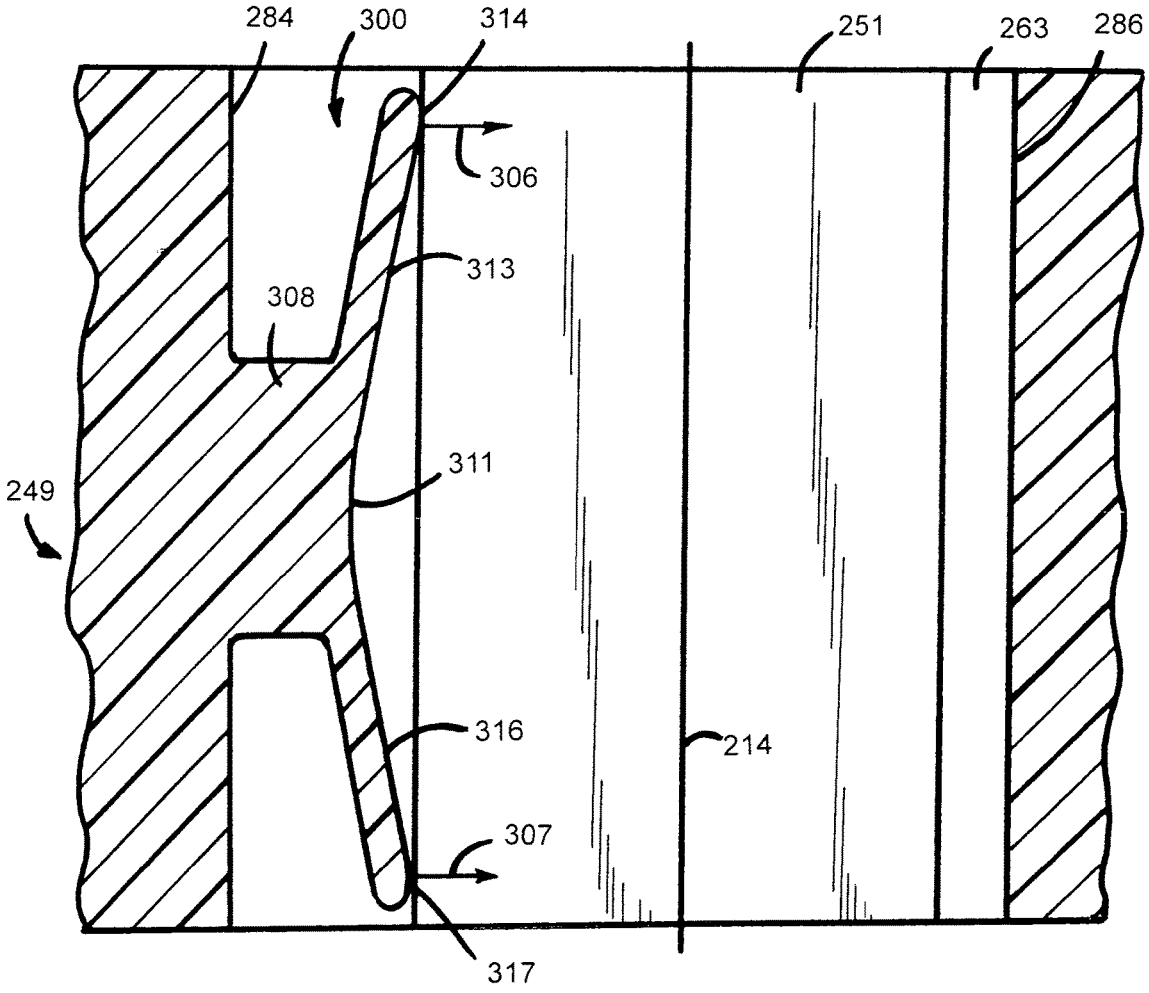
FIG. 55 is an enlarged sectional view taken along line 55-55 of FIG. 47.
Figure 56:
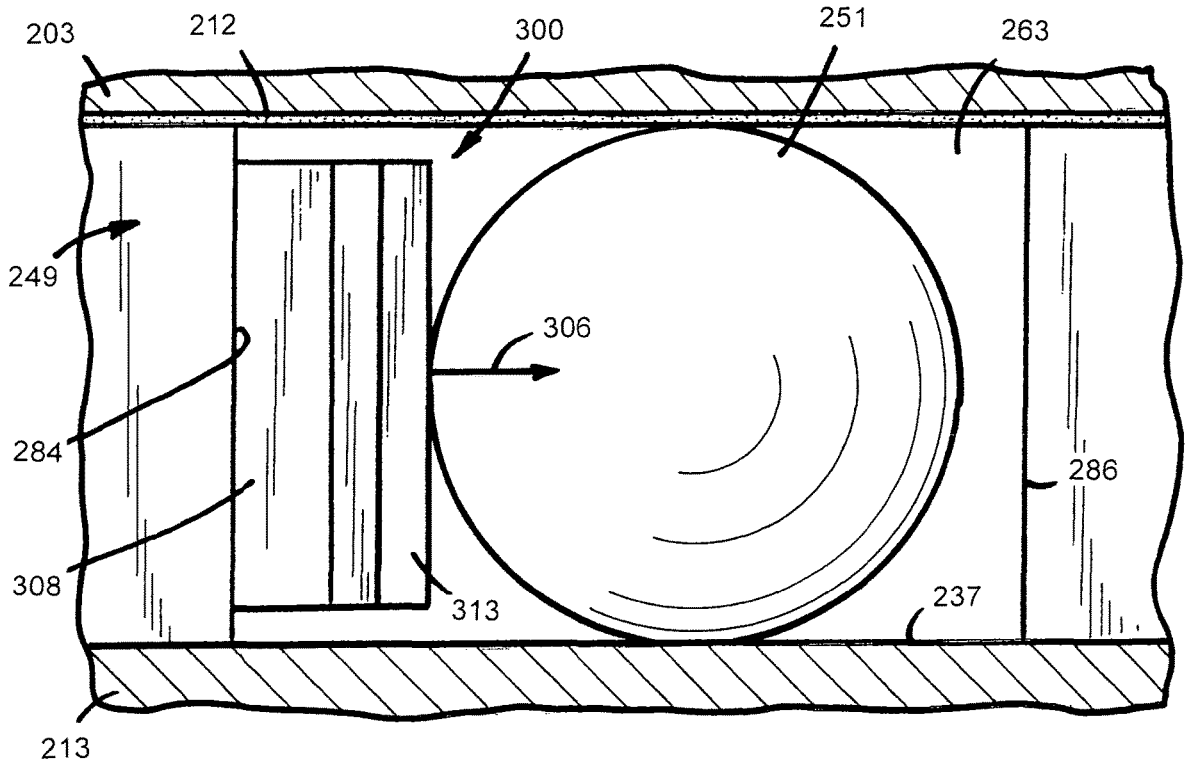
FIG. 56 is a top plan view of FIG. 55.

Proceeding to FIGS. 55 and 56, boss 308 of retainer 300 is joined to wall 284 of cage 249. A connector and a layer of bonding material, such as an adhesive or glue, can be used to secure the entire boss 308 to the adjacent flat portion of wall 284 of cage 249. Other types of connectors can be used to attach retainer to cage 249. The outer flat surfaces 314 and 317 are in line contact opposite end portions of wedging member 251. Arms 313 and 316 bias with equal elastic force the opposite end portions of wedging member 251 laterally and perpendicular to axis 214 of wedging member 251, as shown by arrows 306 and 307 in FIG. 55. Arms 313 and 316 maintain the cartesian relationship of wedging member 251 relative to ramp 237 and cylindrical inside wall 212 of head 203.

Retainers 300 to 305 maintain all of the wedging elements 251 to 256 in contact or engaging positions with respect to ramps 237 to 242 and cylindrical inside wall 212 of head 203. In use when handle 201 is turned a first arcuate direction, shown by arrow 209 in FIGS. 37, 46 and 47, all of the wedging members 251 to 256 concurrently shift from their engaging positions to driving or wedging positions relative to ramps 237 to 242 whereby the torque applied to handle 201 is transmitted to body 213 to rotate fastener 208 associated with body 213. Movement of cylindrical inside wall 212 of head 203 rotates or shifts wedging member 251 to 256 from the engaging positions relative to ramps 237 to 242 and cylindrical inside wall 212 of head 203 to their wedging positions between ramps 237 to 242 and cylindrical inside wall 212 of head 203. Turning handle 201 in a second arcuate direction opposite the first arcuate direction, shown by the broken line arrow 211 in FIGS. 37, 46 and 47, shifts wedging members 251 to 256 back from the wedging positions to the engaging positions with respect to ramps 237 to 242 and cylindrical inside wall 212 of head 203. Body 213 and the fastener connected to body 213 are not rotated when handle 201 is turned in the second arcuate direction.

Preferred embodiments of the wrench have been illustrated and described. Modifications of the structure, materials and configurations may be made by persons skilled in the art without departing from the scope of the invention as defined in the claims.

The invention claimed is:

1. A wrench for rotating a fastener comprising:

a handle having an end, a head joined to the end of the handle, said head having a cylindrical inside wall surrounding an opening extended through the head, a body located in the opening and rotatably retained on the head, said body having an inside wall and members engageable with a fastener for rotating the fastener, said body including a plurality of protrusions located adjacent to the cylindrical wall of the head, each protrusion including an outwardly extended shoulder, a ramp and a ridge located between the shoulder and the ramp, said ramp including a linear surface inclined outwardly from the shoulder to the ridge, said ridge having a first corner at a first end of the ridge and the shoulder and a second corner at a second end of the ridge and ramp, cylindrical rollers engaging the linear surfaces of the ramps and the inside cylindrical wall of the head, a cage located around the body, said cage having openings confining the cylindrical rollers to positions on the linear surfaces of the ramps whereby all of the cylindrical rollers concurrently engage the linear surfaces of the ramps and the cylindrical inside wall of the head, and said cage having first ribs engaging the first corners of the ridges and second ribs engaging the second corners of the ridges to prevent movement of the cage relative to the body, and retainers connected to the cage for biasing all the cylindrical rollers in engagement with the linear surfaces of the ramps and cylindrical inside wall of the head whereby movement of the handle in one direction rotates the head and wedges the cylindrical rollers between the linear surfaces of the ramps and the cylindrical inside wall of the head and rotates the body, and movement of the handle in a direction opposite the one direction releases the wedging of the cylindrical rollers with the linear surfaces of the ramps and the cylindrical inside wall of the head and inhibits rotation of the body relative to the head.

2. The wrench of claim 1 wherein:

the cage has a cylindrical sleeve surrounding the plurality of protrusions, said cylindrical sleeve of the cage having slots accommodating the cylindrical rollers to retain the cylindrical rollers in engagement with the inclined surfaces of the ramps and the cylindrical inside wall of the head.

3. The wrench of claim 2 wherein:

the sleeve of the cage has surfaces between the slots located in contiguous relation to the cylindrical inside wall of the head.

4. The wrench of claim 2 wherein:

the sleeve of the cage has arcuate segments having end walls, the end walls of adjacent segments being spaced from each other providing the slots accommodating the cylindrical rollers.

5. The wrench of claim 4 wherein:

the arcuate segments of the sleeve have surfaces located concentric with the cylindrical inside wall of the head.

6. The wrench of claim 1 wherein:

the retainers comprise bosses joined to the cage and extended into the openings of the cage, and at least one arm connected to each of the bosses, said at least one arm being engageable with one of the cylindrical rollers to bias the one of the cylindrical rollers into engagement with a ramp and the cylindrical inside wall of the head.

7. The wrench of claim 1 wherein:

the retainers comprise bosses joined to the cage and extended into the openings of the cage, first arms connected to the bosses, said first arms having ends engageable with the cylindrical rollers, second arms connected to the bosses, and said second arms having ends engageable with the cylindrical rollers, said first and second arms being connected to the bosses to concurrently bias the rollers into engagement with the ramps and the cylindrical inside wall of the head.

8. A wrench for rotating a fastener comprising:

a handle, a head joined to the handle, said head having a cylindrical inside wall surrounding an opening, a body located in the opening and rotatably retained on the head, said body including a wall with members engageable with a fastener for rotating the fastener, said body also including a plurality of protrusions extended toward the cylindrical inside wall of the head, each protrusion including a ramp inclined outwardly toward the inside cylindrical wall of the head, a cylindrical roller engaging each ramp and the cylindrical inside wall of the head, a cage located around the body confining each cylindrical roller to a location on the ramp whereby all of the cylindrical rollers are in positions to concurrently engage the ramps and the cylindrical inside wall of the head, the cage including a cylindrical side wall having a plurality of slots, the cylindrical side wall having wall segments between adjacent slots, said wall segments having surfaces in contiguous relation relative to the cylindrical inside wall of the head, one of said cylindrical rollers being located in each slot, retainers operably connected to the cage to bias the cylindrical rollers in positions that locate all of the cylindrical rollers in engagement with the ramps and the cylindrical inside wall of the head, said cage and protrusions including cooperating members that anchor the cage on the protrusions to prevent movement of the cage relative to the body and position the cylindrical rollers contiguous with the ramps and the inside cylindrical wall of the head whereby movement of the handle in one direction rotates the head and wedges the cylindrical rollers between the ramps and the cylindrical inside wall of the head and rotates the body, and movement of the handle in a direction opposite the one direction releases the wedging of the cylindrical rollers with the ramps and the cylindrical inside wall of the head and inhibits rotation of the body relative to the head.

9. The wrench of claim 8 wherein:

the cooperating members of the cage and protrusions comprise at least one member on the cage engageable with a protrusion to prevent movement of the cage relative to the body.

10. The wrench of claim 8 wherein:

the cooperating members of the cage and protrusions comprise a plurality of members on the cage engageable with the protrusions to prevent movement of the cage relative to the body.

11. The wrench of claim 8 wherein:

each ramp has an outer end adjacent the inside cylindrical wall of the head, each protrusion including a ridge at the outer end of the ramp, and the cooperating members of the cage and protrusions comprise at least one member engageable with the ridge to prevent movement of the cage relative to the body.

12. The wrench of claim 11 wherein:
the ridge includes corners, and
the cooperating members of the cage and protrusions comprise ribs on the cage engageable with the corners of the ridge to prevent movement of the cage relative to the body.

13. The wrench of claim 8 wherein:
the retainers comprise bosses joined to the cage and extended into the slots of the cage, and
at least one arm connected to each of the bosses, said at least one arm being engageable with one of the rollers to bias the one of the rollers into engagement with a ramp and the cylindrical inside wall of the head.

14. The wrench of claim 8 wherein:
the retainers comprise bosses joined to the cage and extended into the slots of the cage,
first arms connected to the bosses,
said first arms having ends engageable with the rollers,
second arms connected to the bosses, and
said second arms having ends engageable with the rollers,
said first and second arms connected to the bosses to concurrently bias the rollers into engagement with the ramps and the cylindrical inside wall of the head.

15. A wrench for rotating a fastener comprising:
a handle,
a head joined to the handle,
said head having a cylindrical inside wall surrounding an opening,
a body located in the opening and rotatably retained on the head,
said body including members engageable with a fastener for rotating the fastener,
said body including a plurality of ramps inclined outwardly toward the cylindrical inside wall of the head,
a cylindrical roller engaging each ramp and the cylindrical inside wall of the head,
a cage located around the body,
said cage confining each cylindrical roller to a location on a ramp,
retainers supported by the cage and engageable with the cylindrical rollers to concurrently engage the cylindrical rollers with the ramps and the cylindrical inside wall of the head, and
said cage and the body including cooperating members that anchor the cage on the body to prevent movement of the cage relative to the body whereby movement of the handle in one direction rotates the head and wedges all of the cylindrical rollers between the ramps and the cylindrical inside wall of the head and rotates the body, and movement of the handle in a direction opposite the one direction releases the wedging of all of the cylindrical rollers with the ramps and the cylindrical inside wall of the head and inhibits rotation of the body relative to the head.

16. The wrench of claim 15 wherein:
the cooperating members of the cage and the body comprise at least one member on the cage engageable with the body to prevent movement of the cage relative to the body.

17. The wrench of claim 15 wherein:
the cooperating members of the cage and the body comprise a plurality of members on the cage engageable with the body to prevent movement of the cage relative to the body.

18. The wrench of claim 15 wherein:
the retainers comprise bosses joined to the cage, and
at least one arm connected to each of the bosses, said at least one arm being engageable with one of the cylindrical rollers to bias the one of the cylindrical rollers into engagement with a ramp and the cylindrical inside wall of the head.

19. The wrench of claim 15 wherein:
the retainers comprise bosses joined to the cage,
first arms connected to the bosses,
said first arms having ends engageable with the cylindrical rollers,
second arms connected to the bosses, and
said second arms having ends engageable with the cylindrical rollers,
said first and second arms being connected to the bosses to concurrently bias the cylindrical rollers into engagement with the ramps and the cylindrical inside wall of the head.

20. A wrench for rotating a fastener comprising:
a head having a cylindrical inside wall surrounding an opening,
a body located in the opening and rotatably retained on the head,
said body including members engageable with a fastener for rotating the fastener,
said body also including a plurality of ramps facing the cylindrical inside wall of the head,
each ramp being inclined outwardly toward the cylindrical inside wall of the head,
a wedging member engaging each ramp and the cylindrical inside wall of the head,
a cage located around the body confining each wedging member to a location on the ramp whereby all of the wedging members are in positions to concurrently engage the ramps and the inside cylindrical wall of the head,
the cage including a cylindrical side wall having a plurality of slots,
the cylindrical side wall having wall segments between adjacent slots,
the wall segments having surfaces located in contiguous relation relative to the cylindrical inside wall of the head,
the wedging members being located in each slot,
retainers connected to the cage and extended into the slots to bias the wedging member in positions that locate the wedging member in engagement with the ramp and the cylindrical inside wall of the head,
said cage and the body including cooperating members that anchor the cage on the body to prevent movement of the cage relative to the body and hold the wedging member contiguous with the ramp and the cylindrical inside wall of the head whereby movement of the handle in one direction rotates the head and wedges the wedging member between the ramp and the cylindrical inside wall of the head and rotates the body, and movement of the handle in a direction opposite the one direction releases the wedging of the wedging member with the ramp and the cylindrical inside wall of the head and inhibits rotation of the body relative to the head.

21. The wrench of claim 20 wherein:
the cooperating members of the cage and the body comprise at least one member on the cage engageable with the body to prevent movement of the cage relative to the body.

22. The wrench of claim 20 wherein:

the cooperating members of the cage and the body comprise a plurality of members on the cage engageable with the body to prevent movement of the cage relative to the body.

23. The wrench of claim 20 wherein:

the retainers comprise bosses joined to the cage and extended into the slots of the cage, and at least one arm connected to each of the bosses, said at least one arm being engageable with the wedging member to bias the wedging member into engagement with a ramp and the cylindrical inside wall of the head.

24. The wrench of claim 20 wherein:

the retainer comprises bosses joined to the cage and extended into the slots of the cage, first arms connected to the bosses, said first arms having ends engageable with the wedging members, second arms connected to the bosses, and said second arms having ends engageable with the wedging member, said first and second arms being connected to the bosses to concurrently bias the wedging member into engagement with the ramp and the cylindrical inside wall of the head.

25. A method of converting reciprocating motion to unidirectional motion with a wrench having a head including a cylindrical inside wall and a body having ramps, a cage holding cylindrical rollers between the cylindrical inside wall and the ramps and retainers secured to the cage comprising:

anchoring the cage to the body to prevent movement of the cage relative to the body and to locate each of the cylindrical rollers in a contiguous position relative to a ramp of the body and the cylindrical inside wall of the head, subjecting each of the cylindrical rollers to a biasing force with the retainers secured to the cage and engaging the cylindrical rollers to maintain engaging positions of the cylindrical rollers with the ramps and the inside wall of the head, moving the head in a first direction to force the cylindrical rollers from the engaging positions to wedging positions on the ramps and the cylindrical inside wall of the head thereby moving the body in the first direction, and moving the head and the cylindrical inside wall in a second direction opposite the first direction to release the wedging positions of the cylindrical rollers relative to the ramps and the cylindrical inside wall of the head.

26. The method of claim 25 wherein:

the biasing force is applied to opposite end portions of the cylindrical rollers to maintain a cartesian relationship of the cylindrical rollers relative to the ramps and the cylindrical inside wall of the head.

27. A wrench for rotating a fastener comprising:

a head having a cylindrical inside wall surrounding an opening, a body located in the opening and rotatably retained on the head, said body including a plurality of ramps facing the cylindrical inside wall of the head, each ramp having a ramp surface inclined outwardly toward the cylindrical inside wall of the head, a cylindrical roller engaging each ramp surface and the cylindrical inside wall of the head, a cylindrical cage located around the body confining each cylindrical roller to a location on the ramp surface whereby all of the cylindrical rollers are in positions to concurrently engage the ramp surfaces and the inside cylindrical wall of the head, the cage including a cylindrical side wall having a plurality of openings, the cylindrical side wall having wall segments between adjacent openings, the wall segments having surfaces located in contiguous relation relative to the cylindrical inside wall of the head, a cylindrical roller being located in each opening, retainers secured to the cylindrical side wall and extended into the openings to bias the cylindrical rollers in positions that locate the cylindrical rollers in engagement with the ramp surfaces and the cylindrical inside wall of the head.

28. The wrench of claim 27 wherein:

the retainers comprise bosses secured to the wall segments of the cage and extended into the openings in the cylindrical side wall of the cage, and at least one arm secured to each of the bosses, said at least one arm being engageable with the cylindrical rollers to bias the cylindrical rollers into engagement with a ramp surface and the cylindrical inside wall of the head.

29. The wrench of claim 27 wherein:

the retainer comprises bosses secured to the wall segments of the cage and extended into the openings in the cylindrical side wall of the cage, first arms connected to the bosses, said first arms having ends engageable with the cylindrical rollers, second arms connected to the bosses, and said second arms having ends engageable with the cylindrical rollers, said first and second arms being secured to the bosses to concurrently bias the cylindrical rollers into engagement with the ramp surfaces and the cylindrical inside wall of the head.

30. A cage and roller assembly for a wrench comprising:

a cylindrical member having a cylindrical side wall, said side wall having a plurality of circumferentially spaced segments, openings between adjacent segments of the side wall, cylindrical rollers located in the openings, retainers secured to the segments of the side wall and extended into the openings, said retainers having bosses secured to the segments of the side wall and extended into the openings, and arms secured to the bosses, said arms having outer ends located in engagement with the cylindrical rollers to locate the cylindrical rollers in the openings between adjacent segments of the side wall.

31. The cage and roller assembly of claim 30 wherein:

each of the arms secured to the bosses comprise a first linear arm having a first end engageable with a cylindrical roller, and a second linear arm having a second end engageable with the cylindrical roller.

* * * * *